US011091343B2

(12) United States Patent
Nakahata et al.

(10) Patent No.: US 11,091,343 B2
(45) Date of Patent: Aug. 17, 2021

(54) MEDIUM TRANSPORTING APPARATUS, MEDIUM PROCESSING APPARATUS, AND RECORDING SYSTEM

(71) Applicant: SEIKO EPSON CORPORATION, Tokyo (JP)

(72) Inventors: Akinobu Nakahata, Shiojiri (JP); Tsuyoshi Furumido, Shiojiri (JP); Masaki Miyazawa, Matsumoto (JP); Kazuyoshi Ohashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/573,068

(22) Filed: Sep. 17, 2019

(65) Prior Publication Data

US 2020/0087095 A1 Mar. 19, 2020

(30) Foreign Application Priority Data

Sep. 18, 2018 (JP) ..... JP2018-173331

(51) Int. Cl.

| | |
|---|---|
| ***B65H 29/20*** | (2006.01) |
| ***B65H 29/12*** | (2006.01) |
| ***B65H 31/34*** | (2006.01) |
| ***B65H 5/06*** | (2006.01) |

(Continued)

(52) U.S. Cl.

CPC ..... *B65H 29/125* (2013.01); *B65H 5/06* (2013.01); *B65H 5/224* (2013.01); *B65H 29/20* (2013.01); *B65H 29/242* (2013.01); *B65H 31/34* (2013.01); *B65H 2801/06* (2013.01)

(58) Field of Classification Search

CPC ..... B65H 29/125; B65H 5/06; B65H 5/224; B65H 37/06; B65H 39/00; B65H 29/20; B65H 29/242; B65H 2801/06; B42C 1/00; B42C 1/10; B42C 1/12; B42C 1/125

See application file for complete search history.

(56) References Cited

U.S. PATENT DOCUMENTS 4,701,094 A * 10/1987 Courjaret et al.
5,435,535 A * 7/1995 Suzuki ..... B42C 1/12 270/58.02

(Continued)

FOREIGN PATENT DOCUMENTS

JP 2006-096546 A 4/2006
JP 2010-195523 A 9/2010

(Continued)

*Primary Examiner* — Thomas A Morrison
(74) *Attorney, Agent, or Firm* — Workman Nydegger

(57) ABSTRACT

A medium transporting apparatus including a transport belt that transports a medium while suctioning the medium against a transport surface, a first tray on which the medium transported with the transport belt is mounted, and a transport roller configured to move between a transporting position that nips the medium with the transport belt, and a retracted position that is a position distanced away from the transport belt with respect to the transporting position, in which the transport roller is positioned at the retracted position when a single medium is transported with the transport belt and is positioned at the transporting position when a plurality of mediums in a superposed state are transported with the transport belt.

16 Claims, 19 Drawing Sheets

(51) Int. Cl.
*B65H 29/24* (2006.01)
*B65H 5/22* (2006.01)

(56) References Cited

U.S. PATENT DOCUMENTS

| | | | | | |
|---|---|---|---|---|---|
| 6,000,693 | A * | 12/1999 | Tranquilla | ..... | B65H 7/02 271/263 |
| 7,248,829 | B2 * | 7/2007 | Kobayashi | ..... | B42C 1/12 270/52.14 |
| 7,355,743 | B2 * | 4/2008 | McManus etal. | | |
| 2016/0031651 | A1 * | 2/2016 | Hsieh | ..... | B65G 21/2036 427/207.1 |

FOREIGN PATENT DOCUMENTS

| | | | |
|---|---|---|---|
| JP | 2012-056131 | A | 3/2012 |
| JP | 2012-240763 | A | 12/2012 |
| JP | 2017-114637 | A | 6/2017 |

* cited by examiner

MEDIUM TRANSPORTING APPARATUS, MEDIUM PROCESSING APPARATUS, AND RECORDING SYSTEM

The present application is based on, and claims priority from JP Application Serial Number 2018-173331, filed Sep. 18, 2018, the disclosure of which is hereby incorporated by reference herein in its entirety.

BACKGROUND

1. Technical Field

The present disclosure relates to a medium transporting apparatus that transports a medium, a medium processing apparatus that includes the medium transporting apparatus, and a recording system that includes the medium transporting apparatus.

2. Related Art

There are medium processing apparatuses that perform a stapling process, a punching process, and the like on a medium. For example, there is a medium processing apparatus that includes a medium transporting apparatus that stacks and matches end portions of transported mediums in a medium tray, and that performs processes such as a stapling process and the like on the mediums stacked on the medium tray. Note that such a medium processing apparatus is, in some cases, incorporated in a recording system that is capable of performing, in a sequential manner, a recording on a medium with a recording apparatus, a representative example thereof being an ink jet printer, and post-processes such as a stapling process and the like on the medium on which recording has been performed.

As an example of such a medium processing apparatus, JP-A-2012-56131 discloses a medium processing apparatus that stacks mediums transported by a transport device on a stacking portion 8 serving as a "medium tray", and that performs a stapling process on the stacked mediums. In JP-A-2012-56131, a charged transport belt 73 that attracts the medium to the belt and that transports the medium is used in a "transport device".

In such a medium processing apparatus, there are cases in which a stacked transporting process, in which the mediums are transported to the medium tray after a preceding medium that is transported first and a succeeding medium that is transported after the preceding medium are superposed on each other, is performed to improve the throughput when a plurality of mediums are stacked on the medium tray. Note that the stacked transporting process is, in some cases, referred to as a buffering process.

As in JP-A-2012-56131, in a case in which a attracting-type transport belt is used as the transport device that transports the medium to the medium tray, when the stacked transporting process is performed, while a first medium that is directly in contact with the transport belt is attracted to the transport belt, a second medium that is superposed on the first medium and that does not directly contact the transport belt is not attracted to the transport belt. Furthermore, even if the second medium is attracted slightly to the transport belt when the size of the second medium is different from the size of the first medium or when the second medium is displaced from the first medium, the attraction force is insufficient. Accordingly, there are cases in which the second medium is not properly transported to the medium tray.

SUMMARY

A medium transporting apparatus of the present disclosure that overcomes the above issue includes a transport belt that transports a medium while suctioning the medium against a transport surface, a medium mount portion on which the medium transported with the transport belt is mounted, and a transport roller configured to move between a transporting position that nips the medium with the transport belt, and a retracted position that is a position distanced away from the transport belt with respect to the transporting position. In the medium transporting apparatus, the transport roller is positioned at the retracted position when a single medium is transported with the transport belt, and is positioned at the transporting position when a plurality of mediums in a superposed state are transported with the transport belt.

DESCRIPTION OF EXEMPLARY EMBODIMENTS

Figure 1:
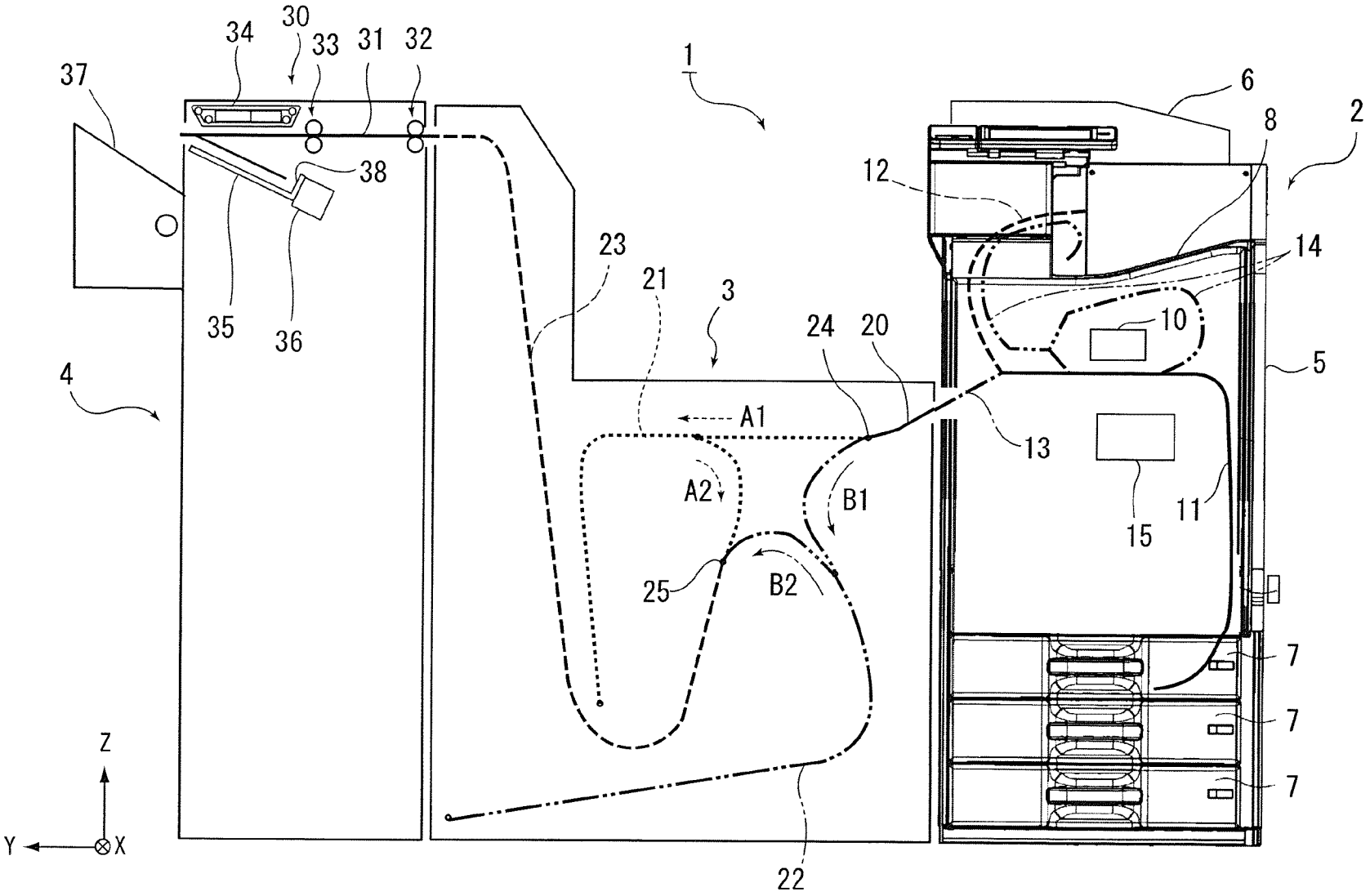
FIG. 1 is a schematic view of a recording system according to a first embodiment.

Hereinafter, the present disclosure will be described in a schematic manner.

A medium transporting apparatus according to a first aspect includes a transport belt that transports a medium while suctioning the medium against a transport surface, a medium mount portion on which the medium transported with the transport belt is mounted, and a transport roller configured to move between a transporting position that nips the medium with the transport belt, and a retracted position that is a position distanced away from the transport belt with respect to the transporting position. In the medium transporting apparatus, the transport roller is positioned at the retracted position when a single medium is transported with the transport belt, and is positioned at the transporting position when a plurality of mediums in a superposed state are transported with the transport belt.

The present aspect includes the transport belt that transports the medium while suctioning the medium against the transport surface, the medium mount portion on which the medium transported with the transport belt is mounted, and the transport roller configured to move between the transporting position configured to nip the medium with the transport belt and the retracted position that is a position distanced away from the transport belt with respect to the transporting position, in which the transport roller is positioned at the retracted position when a single medium is transported with the transport belt, and is positioned at the transporting position when a plurality of mediums in a superposed state are transported with the transport belt; accordingly, even when a plurality of mediums are superposed on each other, the transport belt and the transport roller can transport the plurality of mediums. Accordingly, a plurality of mediums can be sent all at once with the transport belt and can be appropriately mounted on the medium mount portion.

In a second aspect according to the first aspect, the transport belt may transport the medium in a first transport direction and, after that, transport the medium in a second transport direction that is opposite the first transport direction and may mount the medium on the medium mount portion.

An effect similar to that of the first aspect can be obtained in the present aspect in which the medium transporting apparatus is configured so that, after transporting the medium in a first transport direction, the transport belt transports the medium in a second transport direction that is opposite the first transport direction and mounts the medium on the medium mount portion.

In a third aspect according to the second aspect, the transporting position of the transport roller may be upstream of a position of a leading edge of the medium in the first transport direction and may be downstream of a position of a trailing edge of the medium in the first transport direction when a transport direction of the medium is switched from the first transport direction to the second transport direction.

According to the present aspect, since the transporting position of the transport roller is upstream of the position of the leading edge of the medium in the first transport direction and is downstream of the position of the trailing edge of the medium in the first transport direction when the transport direction of the medium is switched from the first transport direction to the second transport direction, the plurality of mediums can be nipped between the transport belt and the transport roller and can be transported in a further reliable manner in a configuration in which, after transporting the medium in the first transport direction with the transport belt, the medium is transported in the second transport direction that is opposite the first transport direction and the medium is mounted on the medium mount portion.

In a fourth aspect according to the second or third aspect, the transport roller may be configured to move from the transporting position to the retracted position when transporting of the medium to the second transport direction is stopped.

The present aspect, after sending the plurality of superposed mediums to the medium mount portion, the transport roller can be moved from the transporting position to the retracted position; accordingly, incidents such as the transport roller at the transporting position obstructing the succeeding medium from being suctioned against the transport belt can be suppressed.

A fifth aspect according to any one of the first to fourth aspects may include a guide portion configured to switch between a first state that guides the medium in a direction oriented towards a portion between the transport roller at the transporting position and the transport belt, and a second state in which the guide portion is situated along a mount surface of the medium mount portion. The guide portion may be switched from the second state to the first state when the transport roller moves from the retracted position to the transporting position.

According to the present aspect, the guide portion that is configured to switch between the first state that guides the medium in the direction oriented towards the portion between the transport roller at the transporting position and the transport belt, and the second state in which the guide portion is situated along the mount surface of the medium mount portion is provided, in which the guide portion is switched from the second state to the first state when the transport roller moves from the retracted position to the transporting position; accordingly, when a plurality of mediums are sent to the transport belt, the medium that is not directly suctioned against the transport surface can be guided so as to be nipped between the transport roller and the transport belt.

A sixth aspect according to the fifth aspect may include a link mechanism that interlocks a switching of the guide portion from the second state to the first state with a movement of the transport roller from the retracted position to the transporting position.

The present aspect is capable of interlocking the movement of the transport roller from the retracted position to the transporting position with the switching of the guide portion from the second state to the first state with a mechanical composition.

A seventh aspect according to the first aspect may include a driven roller configured to rotate with a movement of the transport belt, in which the transport belt is nipped between the transport roller and the driven roller when the transport roller is positioned at the transporting position.

According to the present aspect, the driven roller configured to rotate with a movement of the transport belt is included, in which the transport belt becomes nipped between the transport roller and the driven roller when the transport roller is positioned at the transporting position; accordingly, an increase in the driving load of transport belt can be suppressed.

The medium processing apparatus according to an eighth aspect includes a transport belt that transports a medium while suctioning the medium against a transport surface, a medium mount portion on which the medium transported with the transport belt is mounted, and a processing portion that performs a process on the medium mounted on the medium mount portion, and a transport roller configured to move between a transporting position that nips the medium with the transport belt, and a retracted position that is a position distanced away from the transport belt with respect to the transporting position, in which the transport roller may be positioned at the retracted position when a single medium is transported with the transport belt, and may be positioned at the transporting position when a plurality of mediums in a superposed state are transported with the transport belt.

According to the present aspect in which the medium processing apparatus includes the processing portion that performs a process on the medium mounted on the medium mount portion, even when a plurality of mediums are superposed on each other, the transport belt and the transport roller can transport the plurality of mediums. Accordingly, a plurality of mediums can be sent all at once with the transport belt and can be appropriately mounted on the medium mount portion.

A recording system according to a ninth aspect includes a recording unit that includes a recording device that performs recording on a medium, and a processing unit that performs a process on the medium on which the recording has been performed in the recording unit. In the recording system, the processing unit includes a transport belt that transports the medium while suctioning the medium against a transport surface, a medium mount portion on which the medium transported with the transport belt is mounted, a processing portion that performs a process on the medium mounted on the medium mount portion, and a transport roller configured to move between a transporting position that nips the medium with the transport belt, and a retracted position that is a position distanced away from the transport belt with respect to the transporting position. The transport roller is positioned at the retracted position when a single medium is transported with the transport belt, and is positioned at the transporting position when a plurality of mediums in a superposed state are transported with the transport belt.

According to the present aspect in which the recording system includes a recording unit that includes a recording device that performs recording on a medium, and a processing unit that performs a process on the medium on which the recording has been performed in the recording unit, even when a plurality of mediums are superposed on each other, the plurality of mediums can be transported with the transport belt and the transport roller. Accordingly, a plurality of mediums can be sent all at once with the transport belt and can be appropriately mounted on the medium mount portion.

A tenth aspect according to the ninth aspect may include an intermediate unit that receives, from the recording unit, the medium on which recording has been performed and that delivers the medium to the processing unit.

An effect similar to that of the ninth aspect can be obtained in the present aspect in which the recording system includes the intermediate unit that receives, from the recording unit, the medium on which recording has been performed and that delivers the medium to the processing unit.

First Embodiment

Hereinafter, a description of a first embodiment will be given with reference to the drawings. In the X-Y-Z coordinate system in each of the drawings, the X-axis direction is a width direction of a medium and indicates a depth direction of the apparatus, the Y-axis direction indicates a width direction of the apparatus, and the Z-axis direction indicates a height direction of the apparatus.

Outline of Recording System

A recording system 1 illustrated in FIG. 1 serving as an example includes, from the right side towards the left side of FIG. 1, a recording unit 2, an intermediate unit 3, and a processing unit 4.

The recording unit 2 includes a line head 10 serving as a "recording device" that performs recording on a medium. The intermediate unit 3 receives the medium on which recording has been performed from the recording unit 2 and delivers the medium to the processing unit 4. The processing unit 4 includes a medium transporting apparatus 30 that transports the medium on which recording has been performed in the recording unit 2, and a processing portion 36 that performs a predetermined process on the medium mounted on a first tray 35 serving as a "medium mount portion" of the medium transporting apparatus 30.

In the recording system 1, the recording unit 2, the intermediate unit 3, and the processing unit 4 are coupled to each other and are configured to transport the medium from the recording unit 2 to the processing unit 4.

The recording system 1 is configured so that a recording operation that is performed on the medium with the recording unit 2, the intermediate unit 3, and the processing unit 4, and other operations can be input from an operation panel (not shown). The operation panel can be, as an example, provided in the recording unit 2.

Hereinafter, outlines of the configurations of the recording unit 2, the intermediate unit 3, and the processing unit 4 will be described in the above order.

Recording Unit

The recording unit 2 illustrated in FIG. 1 is configured as a multifunction machine that includes a printer unit 5 and a scanner unit 6. The printer unit 5 includes the line head 10 (the recording device) that performs recording by ejecting ink, which is a liquid, to the medium. In the present embodiment, the printer unit 5 is configured as a so-called ink jet printer.

A plurality of medium storage cassettes 7 are provided in an apparatus lower portion of the recording unit 2. The recording operation is performed by having the medium stored in one of the medium storage cassettes 7 pass through a transport path 11 depicted by a solid line in the recording unit 2 in FIG. 1 and by having the medium be sent to an area in which recording is performed by the line head 10. The medium on which recording has been performed with the line head 10 is sent either to a first discharge path 12 that is a path through which the medium is discharged to a discharge tray 8 provided above the line head 10 or to a second discharge path 13 that is a path through which the medium is sent to the intermediate unit 3. In the recording unit 2 in FIG. 1, the first discharge path 12 is depicted with a broken line and the second discharge path 13 is depicted with a dot and dash line.

The recording unit 2 includes a inverting path 14 depicted by a two-dot chain line in the recording unit 2 in FIG. 1 and is configured to perform a double-sided recording that performs recording on a second surface of the medium after performing recording on a first surface and inverting the medium.

One or more pairs of transport rollers (not shown) that are examples of devices that transport the medium are disposed in each of the transport path 11, the first discharge path 12, the second discharge path 13, and the inverting path 14.

A control unit 15 that controls operations related to the transport and the recording of the medium in the recording unit 2 is provided in the recording unit 2. The control unit 15 can be configured to control not only the operations in the recording unit 2 but also various operations in the processing unit 4 described later.

Intermediate Unit

The intermediate unit 3 illustrated in FIG. 1 is disposed between the recording unit 2 and the processing unit 4. The intermediate unit 3 is configured to receive, through a receiving path 20, the medium on which recording has been performed sent from the second discharge path 13 of the recording unit 2 and to transport the medium to the processing unit 4. The receiving path 20 is depicted by a solid line in the intermediate unit 3 illustrated in FIG. 1.

In the intermediate unit 3, there are two transport paths that transport the medium. The first transport path is a path through which the medium is transported from the receiving path 20 to a discharge path 23 through a first switchback path 21. The second path is a path through which the medium is transported from the receiving path 20 to the discharge path 23 through a second switchback path 22.

The first switchback path 21 is a path through which the medium is, after being received in an arrow A1 direction, switched back in an arrow A2 direction. The second switchback path 22 is a path through which the medium is, after being received in an arrow B1 direction, switched back in an arrow B2 direction.

The receiving path 20 is branched into the first switchback path 21 and the second switchback path 22 at a branching portion 24. Furthermore, the first switchback path 21 and the second switchback path 22 are merged at a merging portion 25. Accordingly, the medium sent from the receiving path 20 through either of the switchback paths can be delivered to the processing unit 4 through the common discharge path 23.

One or more pairs of transport rollers (not shown) are disposed in each of the receiving path 20, the first switchback path 21, the second switchback path 22, and the discharge path 23.

When recording is performed continuously on a plurality of mediums in the recording unit 2, the mediums that have entered the intermediate unit 3 are alternately sent to the transport path passing through the first switchback path 21 and the transport path passing through the second switchback path 22. With the above, the throughput of medium transportation in the intermediate unit 3 can be increased.

Note that the recording system can be one in which the intermediate unit 3 is omitted. In other words, the processing unit 4 can be directly coupled to the recording unit 2.

When the medium on which recording has been performed in the recording unit 2 is sent to the processing unit 4 through the intermediate unit 3, compared with when the medium is sent directly to the processing unit 4 from the recording unit 2, the transport time is long; accordingly, the ink on the medium can be drier before the medium is transported to the processing unit 4.

Processing Unit

The processing unit 4 illustrated in FIG. 1 includes the medium transporting apparatus 30 and, in the processing portion 36, performs processes on the medium transported in the medium transporting apparatus 30. Examples of the processes performed by the processing portion 36 includes a stapling process and a punching process. In the present embodiment, the medium transporting apparatus 30 transports the medium, which has been delivered from the discharge path 23 of the intermediate unit 3, to a transport path 31.

Medium Transporting Apparatus

The medium transporting apparatus 30 will be described in detail below.

Figure 3:
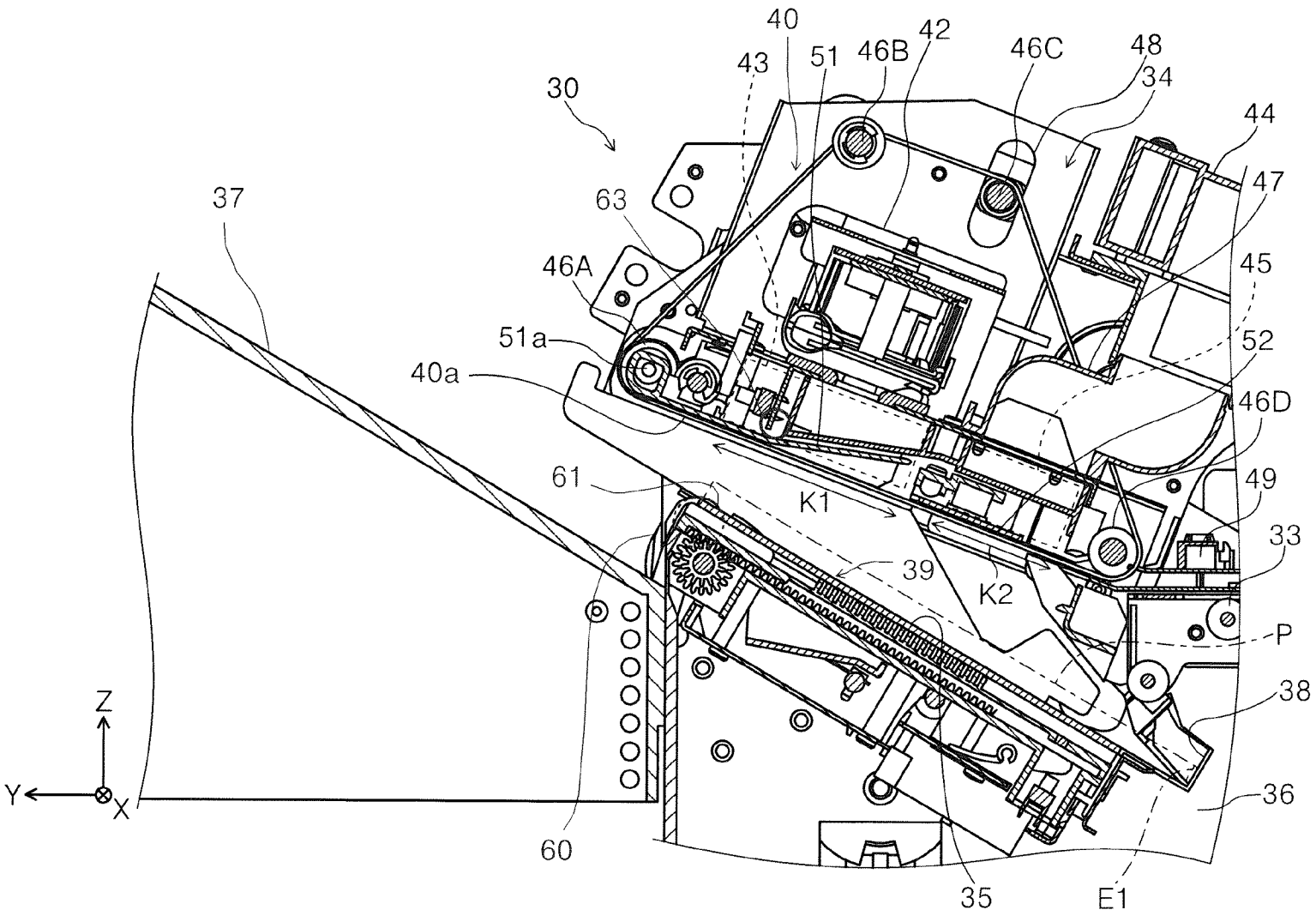
FIG. 3 is a sectional side view of the medium transporting apparatus according to the first embodiment.

The medium transporting apparatus 30 illustrated in FIG. 3 includes transport belts 40, the first tray 35, and transport rollers 61. The transport belts 40 transport the medium while the medium is suctioned against the transport surface 40*a*. The first tray 35 mounts thereon the medium that have been transported thereto with the transport belts 40. A detailed description of the transport rollers 61 will be given after describing the transportation of a medium P to the first tray 35.

A pair of first transport rollers 32 and a pair of second transport rollers 33 that transport the medium in a first transport direction are provided in the processing unit 4 illustrated in FIG. 1, and a transport device 34 that transports the medium with the transport belts 40 is provided downstream of the pair of second transport rollers 33 in the first transport direction. In the present embodiment, since the first transport direction is a direction extending in a +Y direction, hereinafter, the first transport direction will be referred to as a first transport direction +Y.

The transport device 34 is configured to transport the medium in both the first transport direction +Y and a second transport direction that is a direction opposite to the first transport direction +Y. Note that hereinafter, the second transport direction will be referred to as a second transport direction −Y.

Figure 2:
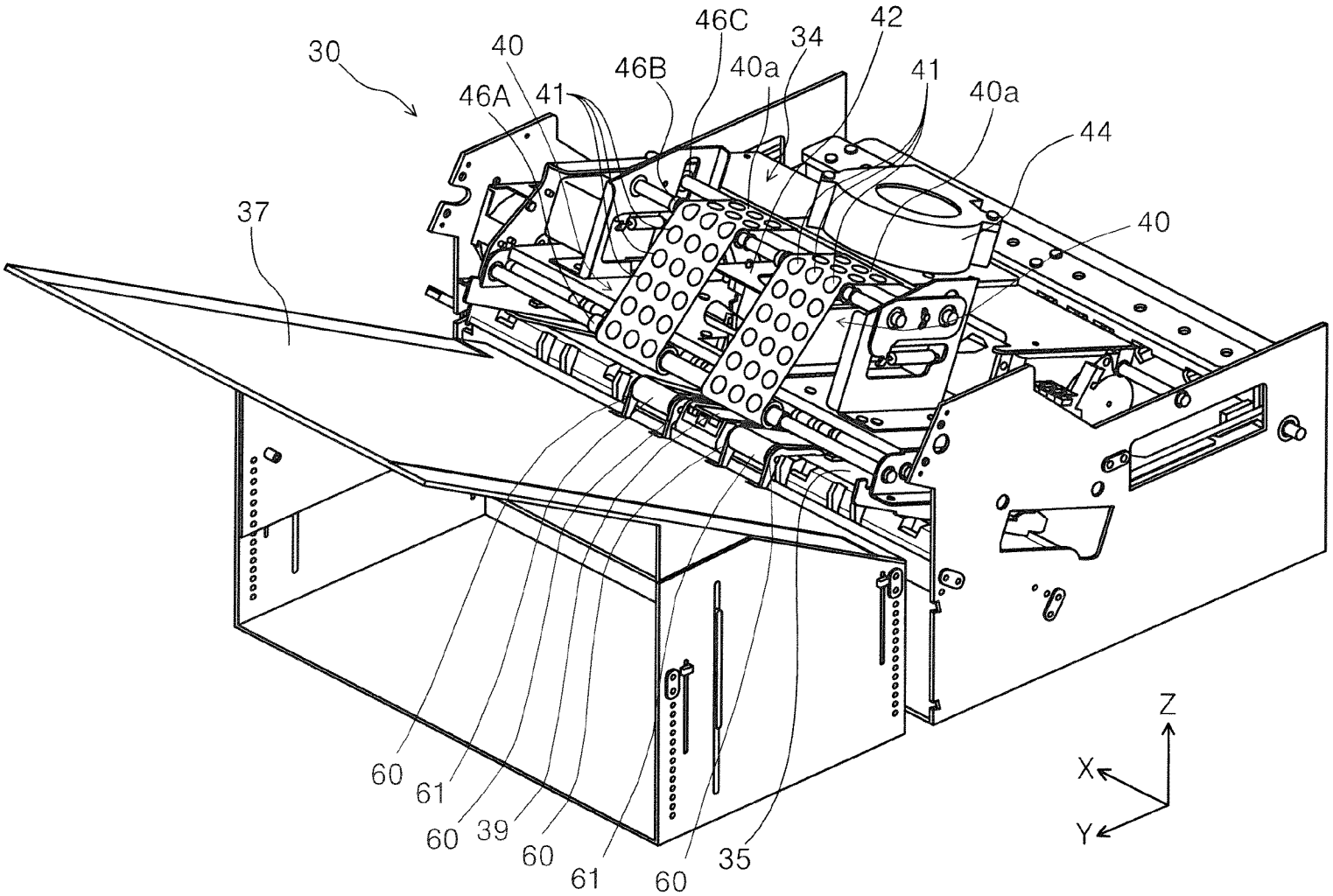
FIG. 2 is a perspective view illustrating a medium transporting apparatus according to the first embodiment.

Referring to FIGS. 2 and 3, a second tray 37 that receives the medium discharged from the first tray 35 is provided downstream of the first tray 35 in the first transport direction +Y. A support portion 39 is provided in the first tray 35.

The medium P that is transported by the transport device 34 is mounted on the first tray 35. In the first tray 35, a first end portion E1 that is an end portion of the medium P positioned upstream in the +Y direction, which is a discharge direction of the medium P, is in contact with a matching portion 38 so that the position of the first end portion E1 is aligned with the matching portion 38. When a plurality of mediums P are mounted on the first tray 35, the first end portions E1 are made to match each other with the matching portion 38.

Figure 12:
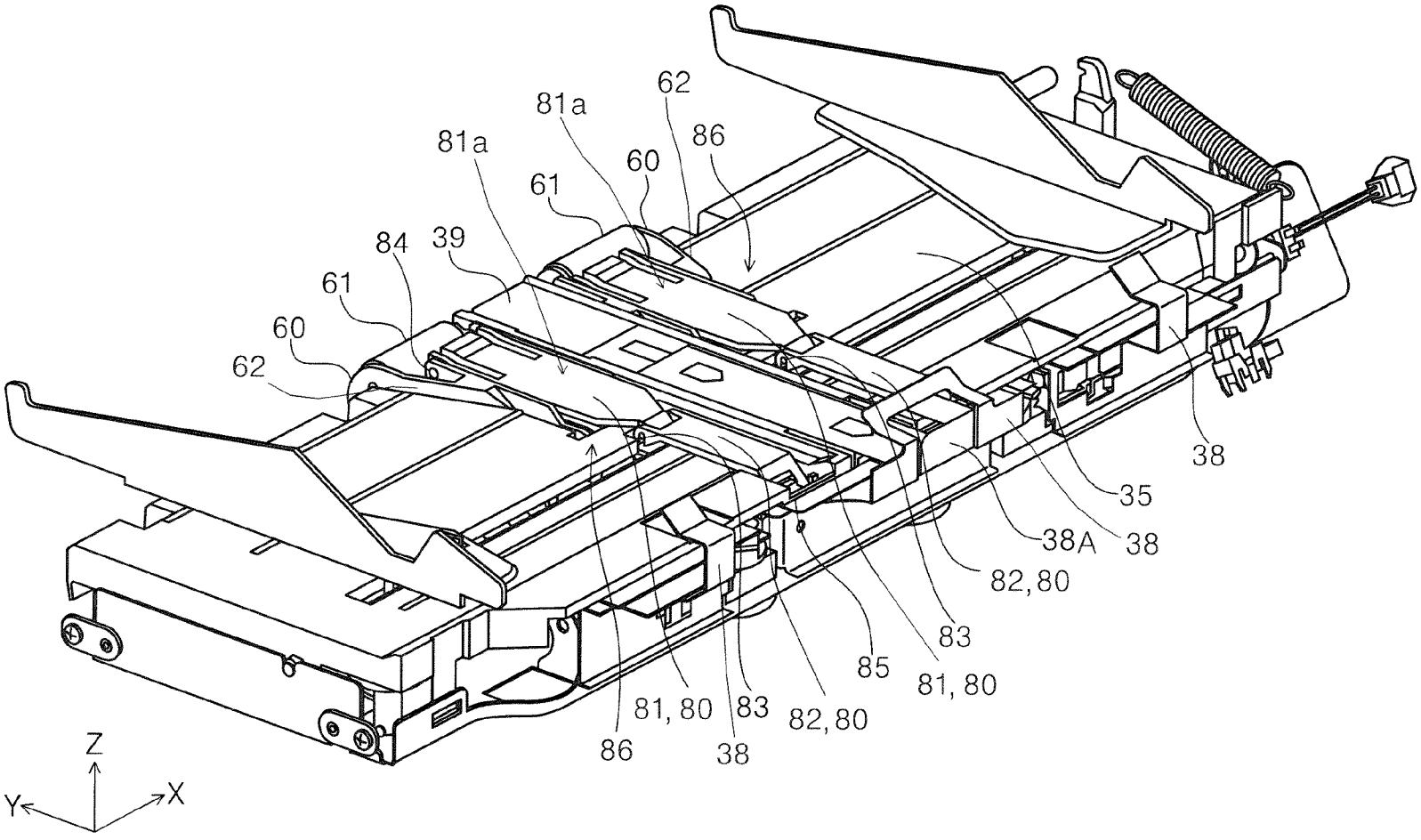
FIG. 12 is a perspective view illustrating the transport rollers at the retracted position and the guide portion in the second state.

As illustrated in FIG. 12 as an example, the matching portion 38 is provided in a plural number in an X-axis direction that is a width direction, and one of the above matching portion 38, which is a matching portion 38A, is provided in the support portion 39.

In the medium transporting apparatus 30 illustrated in FIG. 3, the stapling process or the like is performed with the processing portion 36, which is provided in the vicinity of the matching portion 38, on a single or a plurality of mediums P mounted on the first tray 35 with the first end portions E1 aligned with the matching portion 38. The medium P on which a process has been performed with the processing portion 36 is discharged from the first tray 35 to the second tray 37. The second tray 37 receives the medium P, on which a process has been performed with the processing portion 36, at a portion upstream of a first suction area K1 in the second transport direction −Y.

The first tray 35 is provided below the transport belts 40 that constitute the transport device 34. After transporting the medium P in the first transport direction +Y, the transport belts 40 transport the medium P in the second transport direction −Y and mount the medium P on the first tray 35.

Hereinafter, after describing the transport device 34 that transports the medium P with the transport belts 40, a description of the transportation of the medium P to the first tray 35 with the transport belts 40 will be given.

Transport Device

A detailed description of the transport device 34 that transports the medium with the transport belts 40 will be given next.

In the transport device 34 illustrated in FIG. 3, each transport belt 40 includes a first suction area K1 serving as a "suction area" that suctions the medium against the transport surface 40*a*. Each transport belt 40 is configured to transport the medium in the first transport direction +Y and the second transport direction −Y by rotating and suctioning the medium against the suction area. The transport belts 40 are disposed above the transported medium P. In other words, the transport belts 40 are configured to transport the medium while suctioning the medium thereagainst from above.

In the present embodiment, a second suction area K2 that suctions the medium thereagainst is provided upstream of the first suction area K1 in the first transport direction +Y. Note that in the transport device 34, the second suction area K2 can be omitted.

As illustrated in FIG. 2, two transport belts 40 are provided with a gap in between in the X-axis direction that is a width direction that intersects the first transport direction +Y.

As illustrated in FIG. 3, the annular transport belts 40 are stretched around four rollers, namely, a first roller 46A, a second roller 46B, a third roller 46C, and a fourth roller 46D. The fourth roller 46D is configured to rotate both clockwise and counterclockwise in FIG. 3 with motive force of a drive source (not shown).

Each transport belt 40 suctions the medium thereagainst in the first suction area K1 and the second suction area K2 positioned between the first roller 46A and the fourth roller 46D.

Referring to FIG. 3, when the fourth roller 46D rotates clockwise, the transport belts 40 rotate clockwise as well, and the medium suctioned against the transport belts 40 is transported in the first transport direction +Y. Conversely, when the fourth roller 46D rotates counterclockwise, the transport belts 40 rotate counterclockwise as well, and the medium suctioned against the transport belts 40 is transported in the second transport direction −Y. The third roller 46C is configured to move in a direction of a long hole 48 illustrated in FIG. 3 and is configured to adjust the tensions of the transport belts 40.

As illustrated in FIG. 2, the transport device 34 includes a plurality of holes 41, the annular transport belts 40 that are rotationally driven, and, as illustrated in FIG. 3, first suction portions 43 each disposed on an inner side of the loop of the corresponding transport belt 40. The first suction portions 43 are brought to a negative pressure with the first suction device 42 to generate suction force in some of the plurality of holes 41. A suction pump or a suction fan may be used as the first suction device 42.

More specifically, the first suction portion 43 illustrated in FIG. 3 is suctioned by the first suction device 42 and the space inside the first suction portion 43 is brought to a negative pressure. Lower portions of the first suction portions 43 opposing the transport belts 40 are open and suction force is generated in the holes 41 of the transport belts 40 that pass below the first suction portions 43 that have been brought to a negative pressure. The suction areas corresponding to the first suction portions 43 are the first suction area K1.

Referring further to FIG. 3, second suction portions 45 that generate suction force in some of the plurality of holes 41 by being brought to a negative pressure with the second suction device 44 are provided upstream of the first suction portions 43 in the first transport direction +Y. Note that having a switching position F illustrated in the lower diagram in FIG. 4 described later as a reference, the second suction portion 45 can be expressed as being disposed inside the loops of the transport belts 40 and between the pair of second transport rollers 33 and the switching position F in the first transport direction +Y.

The second suction device 44 suctions the air inside each second suction portion 45 through a conduit 47 and brings the inside of each second suction portion 45 to a negative pressure. A suction pump or a suction fan may be used as the second suction device 44. The suction areas corresponding to the second suction portions 45 are the second suction area K2.

As described later with reference to FIGS. 4 and 5, the transport belts 40 suction the medium P, which has been delivered from the pair of second transport rollers 33, thereagainst and transport the medium P in the first transport direction +Y. When the first end portion E1 of the medium P is transported to a predetermined switching position F, the transport belts 40 transport the medium P in the second transport direction −Y and mount the medium P on the first tray 35.

Transporting Medium to First Tray

Figure 4:
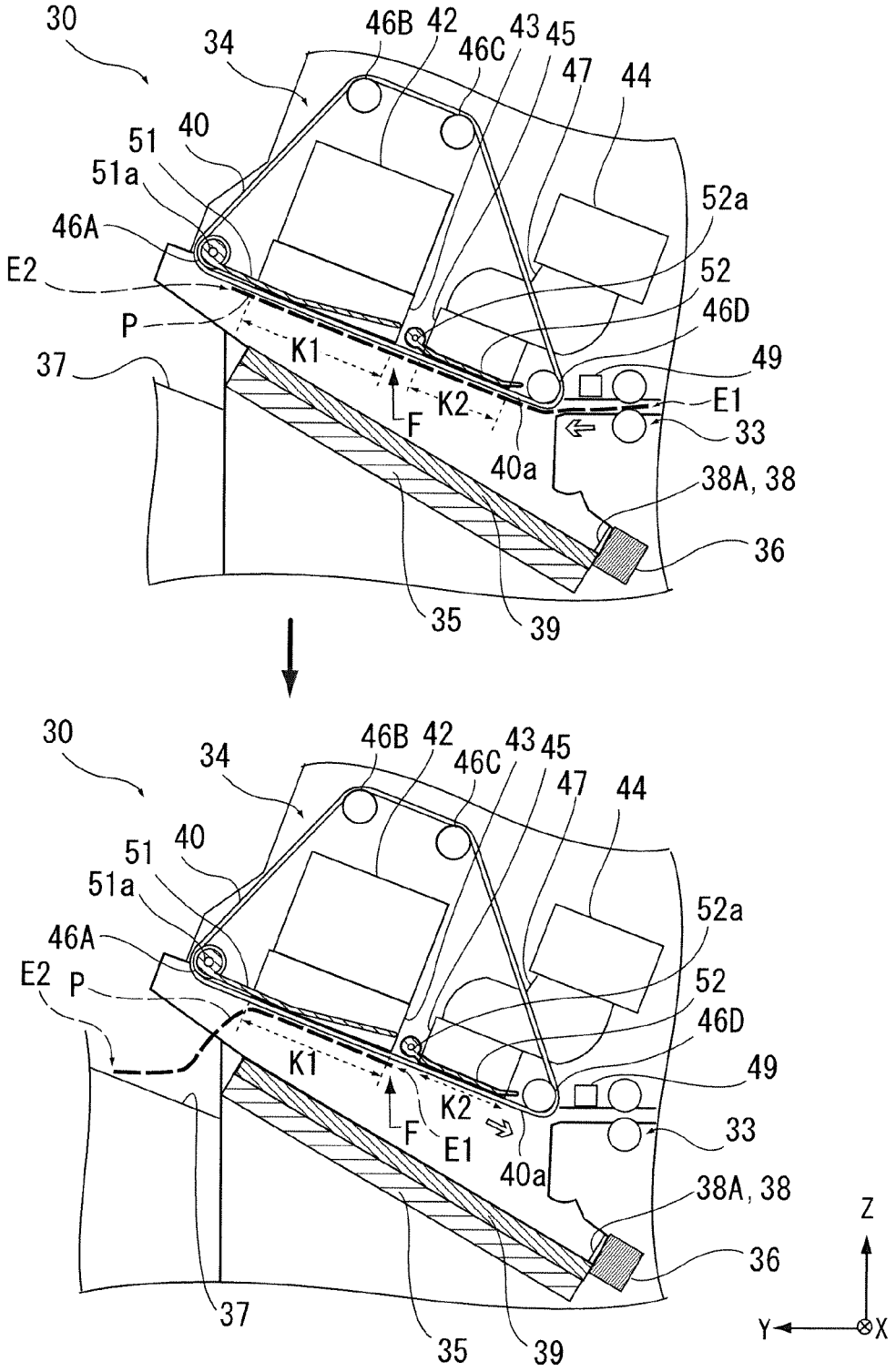
FIG. 4 includes diagrams illustrating transportation of a medium in the processing unit.

The medium P that has been transported in the first transport direction +Y with the pair of second transport rollers 33 is, as illustrated in the upper diagram in FIG. 4, suctioned against the transport belts 40 with the suction force in the first suction area K1 and the second suction area K2 and is transported in the first transport direction +Y. In the upper diagram in FIG. 4, a hollow arrow indicates the moving direction of the transport belts 40. In other words, the transport belts 40 rotate clockwise in the upper diagram in FIG. 4.

When the medium P is transported further from the state in the upper diagram in FIG. 4 and, as illustrated in the lower diagram in FIG. 4, the first end portion E1 of the medium P reaches the switching position F, the rotations of the transport belts 40 are reversed and the medium P is transported in the second transport direction −Y. In other words, the transport belts 40 are rotated counterclockwise in the lower diagram in FIG. 4.

Note that in the present embodiment, a medium detection portion 49 is provided between the transport device 34 and the pair of second transport rollers 33. The timing at which the rotation direction of each transport belt 40 is switched can be determined with the detection of the medium P by the medium detection portion 49 as a reference.

For example, after the transport belts 40 have been rotated clockwise by a predetermined drive amount from when the first end portion E1 of the medium P transported in the first transport direction +Y has been detected by the medium detection portion 49, assuming that the first end portion E1 has been transported to the switching position F, the transport belts 40 are rotated counterclockwise.

Alternatively, a medium detection portion may be provided at the switching position F, and the rotation direction of each transport belt 40 may be switched according to the timing at which the first end portion E1 is detected at the switching position F.

A second separating device 52 that separates the medium P suctioned against the transport belts 40 in the second suction area K2 from the transport belts 40 is provided in the transport device 34. The second separating device 52 including a pivot shaft 52*a* at a portion upstream in the second transport direction −Y is swung relative to the second suction area K2 with the downstream portion as a free end. The second separating device 52 is, as illustrated in the upper diagram in FIG. 4, positioned inside the loops of the transport belts 40 when suctioning the medium P in the second suction area K2, and is, as illustrated in the upper diagram in FIG. 5, swung so as to protrude outside of the loops of the transport belts 40 when separating the medium P suctioned in the second suction area K2 from the transport belts 40.

Figure 6:
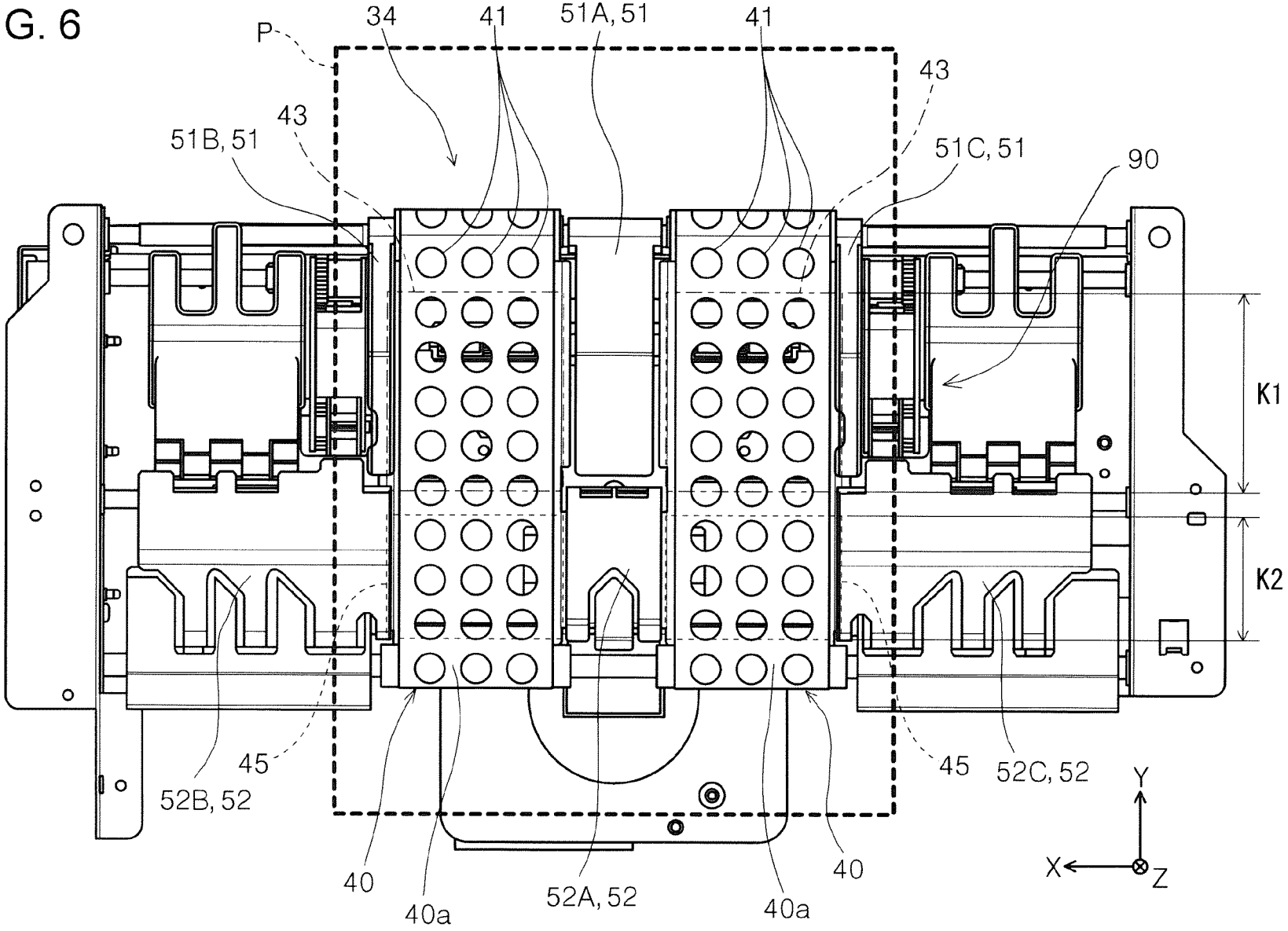
FIG. 6 is a bottom view illustrating a main portion of the medium transporting apparatus.

As illustrated in FIG. 6, the second separating device 52 includes, in the X-axis direction that is the width direction, a second separating device 52A provided between the two transport belts 40, and a second separating device 52B and a second separating device 52C provided on the two sides of the two transport belts 40. In other words, a plurality of second separating devices 52 are provided in the X-axis direction that is a width direction intersecting the second transport direction −Y.

After the first end portion E1 of the medium P transported in the first transport direction +Y is positioned at the switching position F and before the transport direction of the medium P is switched from the first transport direction +Y to the second transport direction −Y, the second separating device 52 is protruded outside of the loops of the transport belts 40.

With the above, when the medium P is transported in the second transport direction −Y, the medium P can be guided towards the first tray 35 positioned below the transport belts 40 while suppressing the medium P from being re-suctioned in the second suction area K2.

Figure 7:
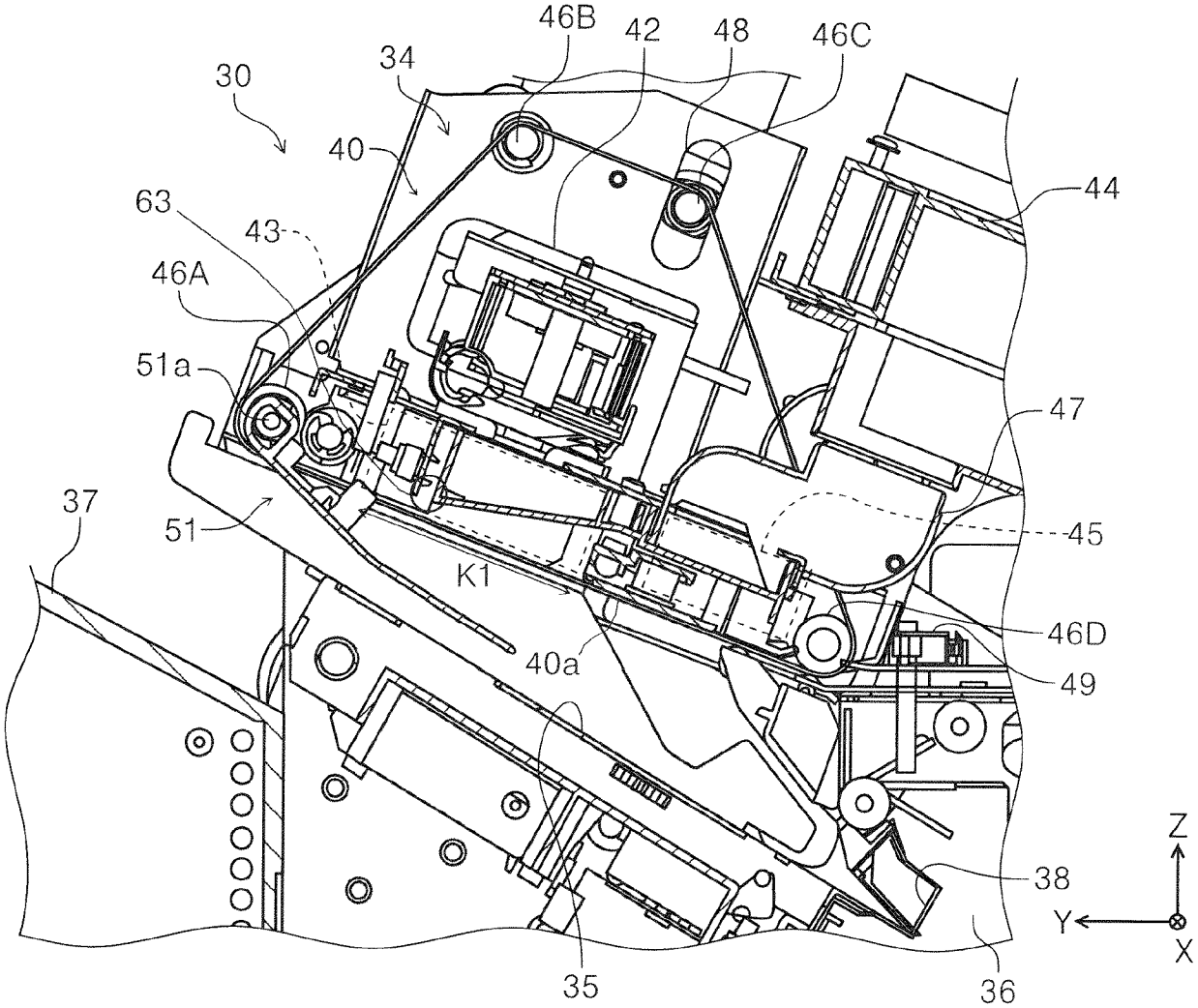
FIG. 7 is a sectional side view illustrating a protruded state of a first separating device.

Furthermore, the medium transporting apparatus 30 includes a first separating device 51 at a position corresponding to the first suction area K1 described above. The first separating device 51 is configured to switch between a protruded state illustrated in FIG. 7 in which the first separating device 51 protrudes from the transport surfaces 40*a* of the transport belts 40, and a retracted state illustrated in FIG. 3 in which the first separating device 51 does not protrude from the transport surfaces 40*a*. The medium P is separated from the transport belts 40 by switching from the retracted state illustrated in FIG. 3 to the protruded state illustrated in FIG. 7.

Figure 5:
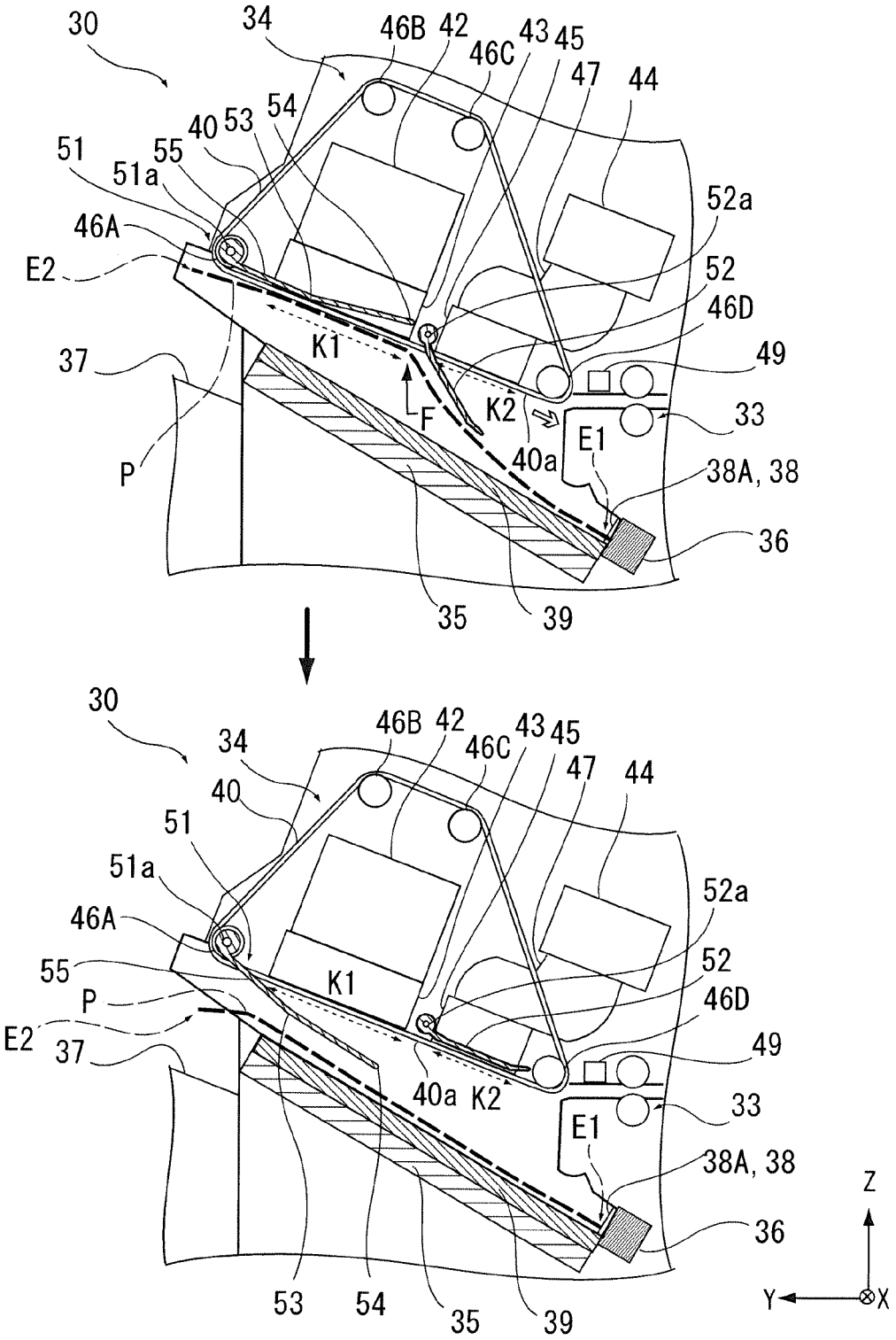
FIG. 5 includes diagrams illustrating transportation of a medium in the processing unit.

When the medium P is sent in the second transport direction −Y with the transport belts 40 and, as illustrated in FIG. 5, when the first end portion E1 of the medium P is positioned at the matching portion 38 of the first tray 35, the rotations of the transport belts 40 are stopped and the first separating device 51 is switched from the retracted state to the protruded state illustrated in the lower diagram in FIG. 5 to separate the medium P from the first suction area K1. Accordingly, the medium P can be mounted on the first tray 35 while the first end portion E1 of the medium P is aligned at a predetermined position.

The rotations of the transport belts 40 can be stopped when a predetermined time has passed from when the transport direction of the medium P has been switched from the first transport direction +Y to the second transport direction −Y, assuming that the first end portion E1 of the medium P has been transported to the position of the matching portion 38. Alternatively, a detection portion configured to detect the first end portion E1 can be provided at the position of the matching portion 38, and the rotations of the transport belts 40 can be stopped at the timing at which the first end portion E1 is detected by the detection portion.

Note that with the operation of bringing the first separating device 51 to the protruded state, the second separating device 52 is retracted to the transport surface 40*a* side as illustrated in the lower diagram in FIG. 5 so that the medium P can be suctioned in the second suction area K2.

Accordingly, when the medium that has been transported first is referred to as a preceding medium P1, while separating the preceding medium P1 from the transport belts 40 with the first separating device 51 and mounting the preceding medium P1 on the first tray 35, a succeeding medium P2 that is transported next can be received and suctioned in the second suction area K2.

When the succeeding medium P2 is transported subsequent to the preceding medium P1, the first separating device 51 is displaced from the retracted state illustrated in the upper diagram in FIG. 5 to the protruded state illustrated in the lower diagram in FIG. 5, and after the preceding medium P1 is separated from the transport belts 40, the protruded state is maintained so that the preceding medium P1 mounted on the first tray 35 is held down. The retracted state is displaced before the succeeding medium P2 reaches the first suction area K1. With the above, incidents such as the preceding medium P1 mounted on the first tray 35 lifting up and being re-suctioned against the transport belts 40 before the succeeding medium P2 reaches the first suction area K1 can be reduced.

The timing at which the first separating device 51 in the protruded state in the lower diagram in FIG. 5 is returned to the retracted state can be, for example, when a predetermined time has passed from the detection of the succeeding medium P2 with the medium detection portion 49. The predetermined time can be set in the range in which, after the succeeding medium P2 has been detected by the medium detection portion 49, the succeeding medium P2 transported in the first transport direction +Y does not reach the first suction area K1.

Furthermore, for example, a medium detection portion different form the medium detection portion 49 can be provided downstream of the medium detection portion 49 and upstream of the first suction area K1 in the first transport direction +Y, and the first separating device 51 can be brought to the retracted state at a timing at which the succeeding medium P2 is detected by the above medium detection portion.

It is desirable that the first separating device 51 be in the protruded state until immediately before the succeeding medium P2 reaches the first suction area K1. With the above, incidents such as the preceding medium P1 being re-suctioned against the transport belts 40 can be reduced further.

Note that the first separating device 51 and the second separating device 52 are swung by motive force of a drive source (not shown). The first separating device 51 and the second separating device 52 can be driven by a common drive source. It goes without saying that the separating devices can be driven by different drive sources.

Figure 8:
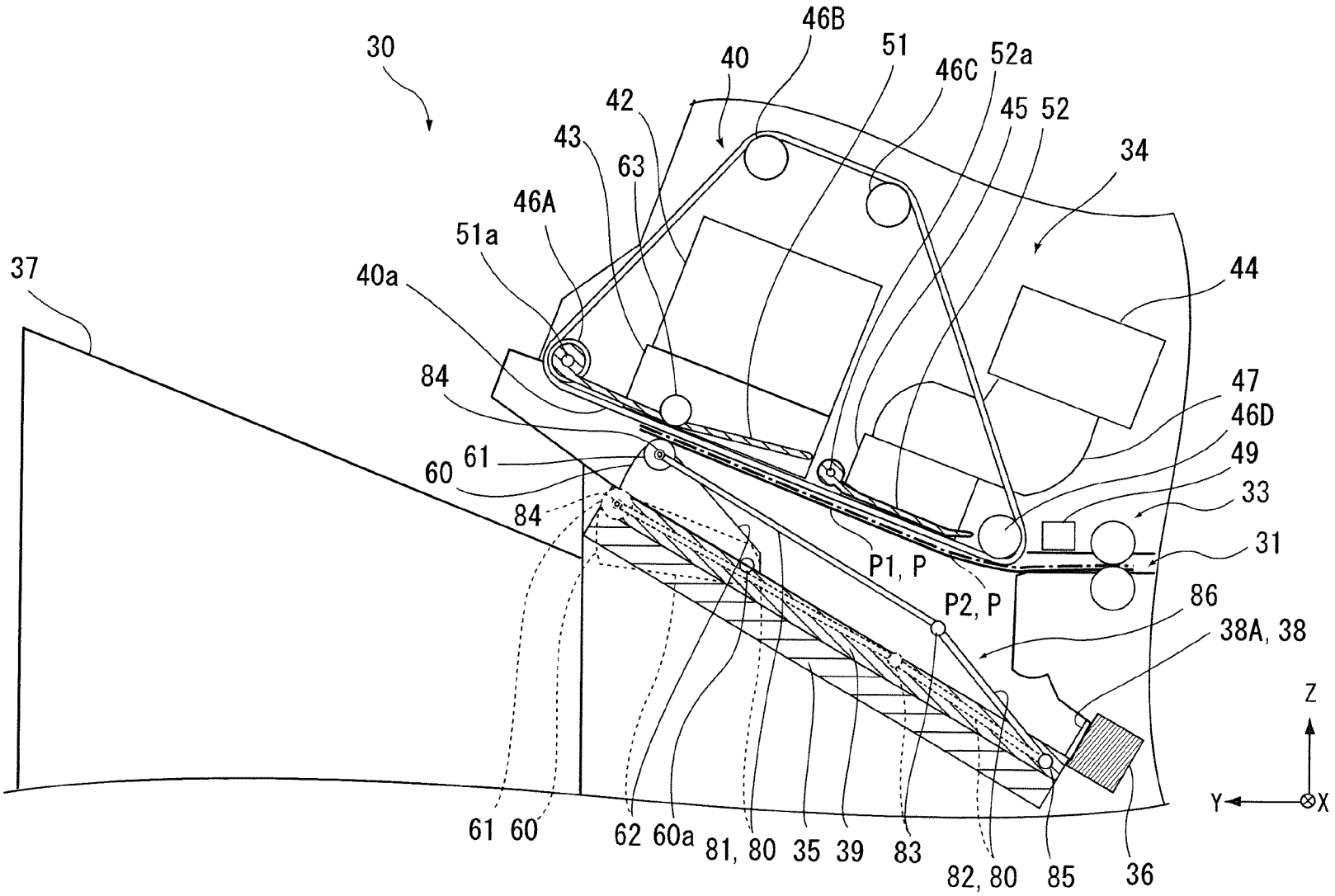
FIG. 8 is a schematic view illustrating a transporting position and a retracted position of a transport roller.

Note that in the processing unit 4, in order to improve the throughput when a plurality of mediums are stacked on the first tray 35, a stacked transporting process may be performed. In the stacked transporting process, the preceding medium P1 and the succeeding medium P2 transported after the preceding medium to the first tray 35 are transported after superposing the above medium on each other as illustrated in FIG. 8. Note that the stacked transporting process is, in some cases, referred to as a buffering process.

Note that the preceding medium P1 and the succeeding medium P2 are superposed on each other at a portion upstream of the medium transporting apparatus 30 in the first transport direction +Y. The preceding medium P1 and the succeeding medium P2 can be superposed in the processing unit 4 or can be superposed in the intermediate unit 3 and then be sent to the processing unit 4.

When attempting to suction the two preceding medium P1 and the succeeding medium P2 against the transport belts 40, the preceding medium P1 positioned on the lower side as in FIG. 8 does not directly contact the transport surfaces 40*a*; accordingly, in the above state, the preceding medium P1 is not suctioned against the transport belts 40. There may be cases in which the preceding medium P1 is suctioned slightly when the sizes of the preceding medium P1 and the succeeding medium P2 are different or, even when the sizes are the same, when the preceding medium P1 and the succeeding medium P2 are slightly displaced from each other; however, the suction force will be insufficient. Accordingly, there are cases in which the preceding medium P1 is not properly transported to the first tray 35 with the transport belts 40.

Since the present embodiment includes the transport rollers 61 described above, both the preceding medium P1 and the succeeding medium P2 superposed on each other can be properly sent to the first tray 35. A description of the transport rollers 61 will be given below.

Note that while in the present embodiment, the succeeding medium P2 is superposed on the preceding medium P1, it goes without saying that the opposite is applicable.

Transport Rollers

Figure 11:
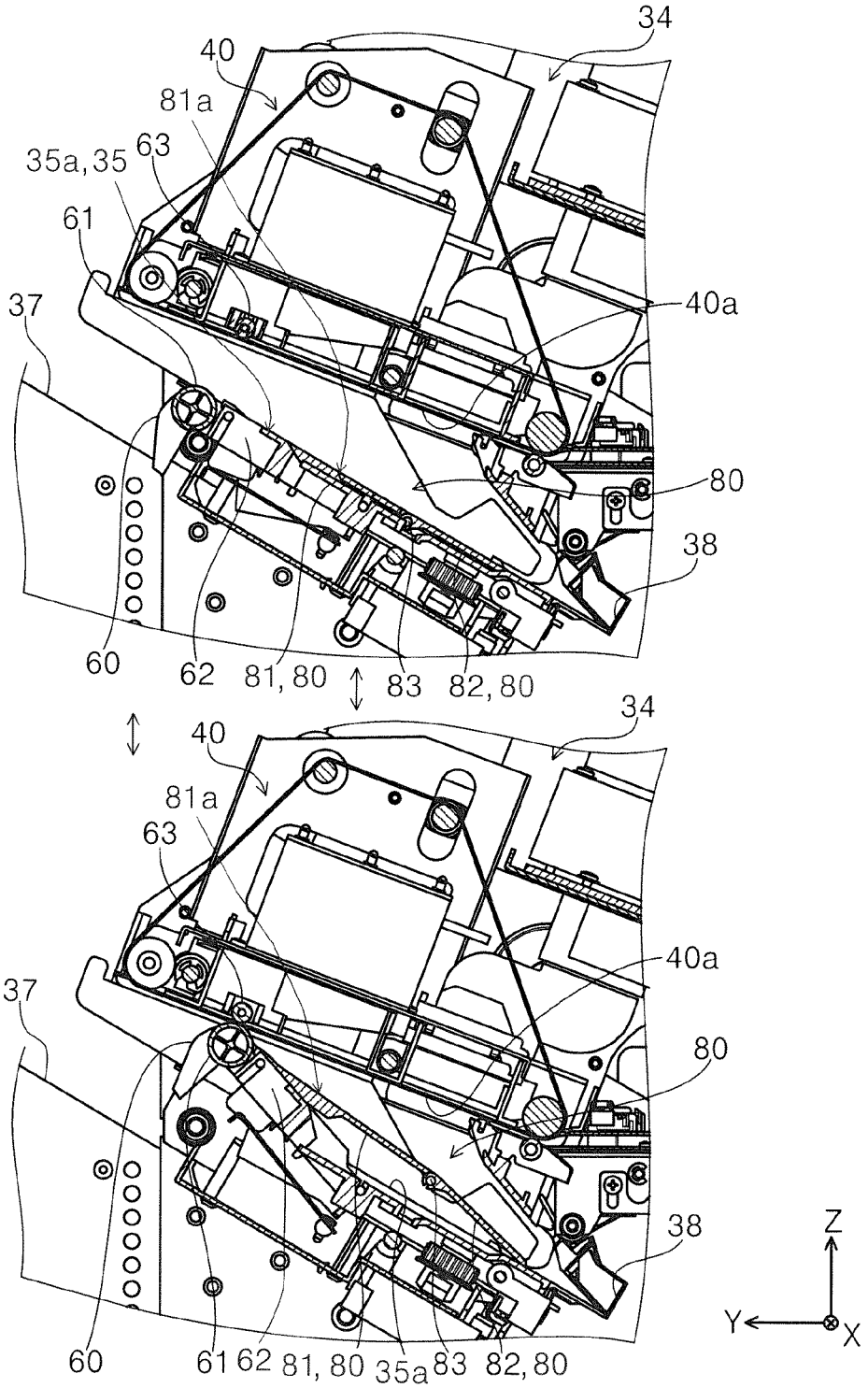
FIG. 11 includes sectional side views of the transporting position and the retracted position of the transport roller, and the first state and a second state of the guide portion.

The transport rollers 61 are configured to move between a transporting position, as in the lower diagram in FIG. 11, configured to nip the medium P with the transport belts 40, and a retracted position, as in the upper diagram in FIG. 11, that is a position distanced away from the transport belts with respect to the transporting position. In FIG. 8, the transport roller 61 at the transporting position is depicted by a solid line, and the transport roller 61 at the retracted position is depicted by a broken line.

More specifically, the transport rollers 61 are supported by base portions 62 including restriction portions 60 described later. The base portions 62 swing about the pivot shafts 60*a* and the transport rollers 61 move between the transporting position and the retracted position.

When a single medium P is transported in the transport belts 40, the transport rollers 61 are positioned at the retracted position and, as in FIG. 8, when a plurality of mediums P are transported in the transport belts 40 in a superposed state, the transport rollers 61 are positioned at the transporting position.

For example, as illustrated in the upper diagram in FIG. 4, when a single medium P is transported, since the medium P is suctioned against the transport surfaces 40*a*, the transport rollers 61 are positioned at the retracted position, and the medium P can be transported with the suction force alone in the transport belts 40.

On the other hand, as illustrated in FIG. 8, when a plurality of mediums P are transported in the transport belts 40 in a superposed state, the transport rollers 61 are set to the transporting position so that the superposed preceding medium P1 and the succeeding medium P2 can be nipped between the transport rollers 61 and the transport belts 40 and be transported. Accordingly, even when the preceding medium P1 positioned on the lower side is not suctioned against the transport surface 40*a*, the preceding medium P1 and the succeeding medium P2 can be transported in a superposed state and can be mounted appropriately on the first tray 35.

The timing at which the transport rollers 61 are moved from the retracted position to the transporting position can be determined, for example, based on the detection of the medium P in the medium detection portion 49. Other than switching at the same time as the detection of the medium P in the medium detection portion 49, the switching may be performed after a predetermined time has passed after the detection of the medium P in the medium detection portion 49.

There are cases in which the detection of the medium P in the medium detection portion 49 is performed by detection of a leading edge (a second end portion E2) of the medium P transported in the first transport direction +Y, and by detection of a trailing edge (the first end portion E1) of the medium P transported in the first transport direction +Y; however, the switching timing may be determined based on either of the detections.

In the present embodiment, while the transport rollers 61 are configured to be rotated by following the rotation of the transport belts 40, the transport rollers 61 can be driving rollers as well. In such a case, when the transport roller 61 receiving driving force from a motor (not shown) rotate in a direction transporting the medium P in the first transport direction +Y, suitably, the medium transport speed of the above is slower than the medium transport speed of the transport belts 40. With the above, the preceding medium P1 and the succeeding medium P2 can be offset from each other, more specifically, the leading edge of the preceding medium P1 in the second transport direction −Y can be positioned downstream in the second transport direction −Y with respect to the leading edge of the succeeding medium P2 in the second transport direction −Y. By offsetting the preceding medium P1 and the succeeding medium P2 from each other in the above manner, when the preceding medium P1 and the succeeding medium P2 are transported in the second transport direction −Y with the transport device 34 and the leading edges thereof are abutted against the matching portion 38A, the leading edge of the preceding medium P1 on the lower side abuts against the matching portion 38A first, and the leading edge of the preceding medium P1 and the leading edge of the succeeding medium P2 can be suitably aligned at the matching portion 38A.

Note that during the above, since the transport rollers 61 contacting the preceding medium P1 needs to be driven and rotated in the reverse direction, the transmission path that transmits the driving force from the motor (not shown) to the transport rollers 61 is disconnected.

Furthermore, in a case in which the transport rollers 61 are driven by the motor (not shown), when the preceding medium P1 and the succeeding medium P2 are transported in the first transport direction +Y, the medium transport speed of the transport rollers 61 and the medium transport speed of the transport belts 40 may be, rather than set different, set the same, and when the preceding medium P1 and the succeeding medium P2 are transported in the second transport direction −Y, the transport rollers 61 may be driven in a reverse manner. By so doing, even if the leading edge of the preceding medium P1 in the second transport direction −Y is positioned upstream in the second transport direction −Y with respect to the leading edge of the succeeding medium P2 in the second transport direction −Y, the leading edge of the preceding medium P1 and the leading edge of the succeeding medium P2 can be suitably aligned at the matching portion 38A.

Furthermore, as illustrated in FIG. 8, the medium transporting apparatus 30 includes, on the inner side of the loops of the transport belts 40, driven rollers 63 that are configured to be rotated with the movement of the transport belts 40. When the transport rollers 61 are positioned at the transporting position, the transport belts 40 are nipped between the transport rollers 61 and the driven rollers 63. With the above, an increase in the driving load of transport belts 40 when the transport rollers 61 are positioned at the transporting position can be suppressed.

Figure 10:
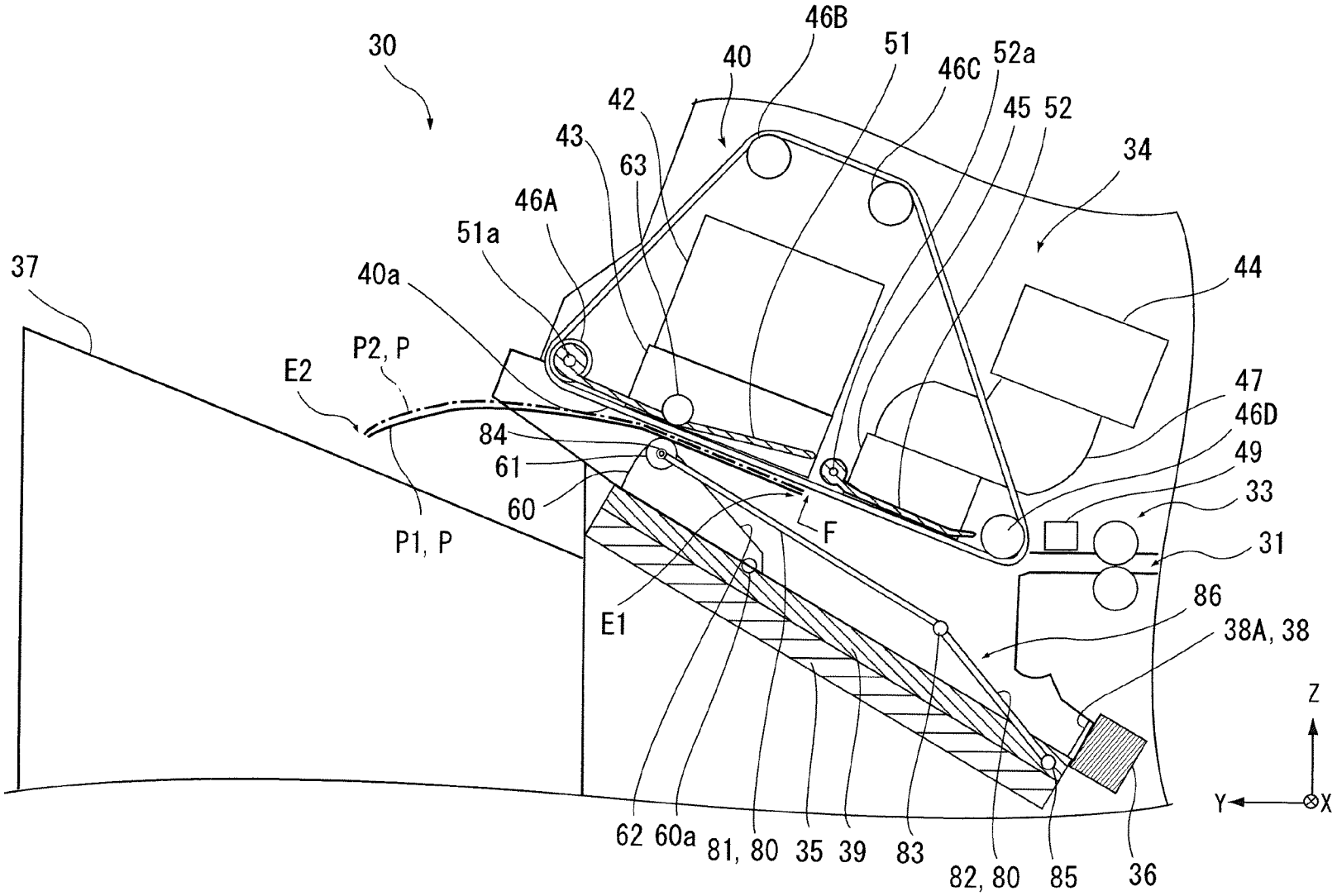
FIG. 10 is a schematic view illustrating a state in which the first end portions of a plurality of mediums are positioned at the switching position.

Furthermore, as illustrated in FIG. 10, the transporting position of the transport rollers 61 is upstream of where the second end portion E2 serving as a leading edge of the medium P in the first transport direction +Y is positioned and downstream of where the first end portion E1 serving as a trailing edge is positioned, when the transport direction of the medium P is switched from the first transport direction +Y to the second transport direction −Y. Note that FIG. 10 is a diagram corresponding to the lower diagram in FIG. 4 and illustrates a state in which the first end portions E1 of the preceding medium P1 and the succeeding medium P2 are at the switching position F.

In a configuration in which the medium P is transported with the transport belts 40 in the second transport direction −Y after being transported in the first transport direction +Y and is mounted on the first tray 35, by having the transporting position of the transport rollers 61 be situated between the first end portion E1 and the second end portion E2 when the transport direction of the medium P is switched from the first transport direction +Y to the second transport direction −Y, a plurality of mediums P can be reliably nipped between the transport belts 40 and the transport rollers 61 and be transported.

Furthermore, the transport rollers 61 are configured to move from the transporting position to the retracted position when the transporting of the medium P towards the second transport direction −Y is stopped.

When the medium P is, after being transported by the transport belts 40 in the first transport direction +Y, transported in the second transport direction −Y and is mounted on the first tray 35, as described above with reference to FIGS. 4 and 5, the transportation of the medium P in the second transport direction −Y is stopped when the first end portion E1 of the medium P is transported to the position of the matching portion 38 and when the medium P is mounted on the first tray 35. When a plurality of mediums P are continuously sent to the first tray 35, the transportation of the succeeding medium P2 is started after the transportation of the preceding medium P1 in the second transport direction −Y has been stopped. With the stoppage of the transportation of the medium P in the second transport direction −Y, the transport rollers 61 are moved from the transporting position to the retracted position; accordingly, incidents such as the transport rollers 61 at the transporting position obstructing the succeeding medium P from being suctioned against the transport belts 40 can be suppressed.

Guide Portion

A description of a guide portion 80 provided in the medium transporting apparatus 30 will be given next.

Figure 13:
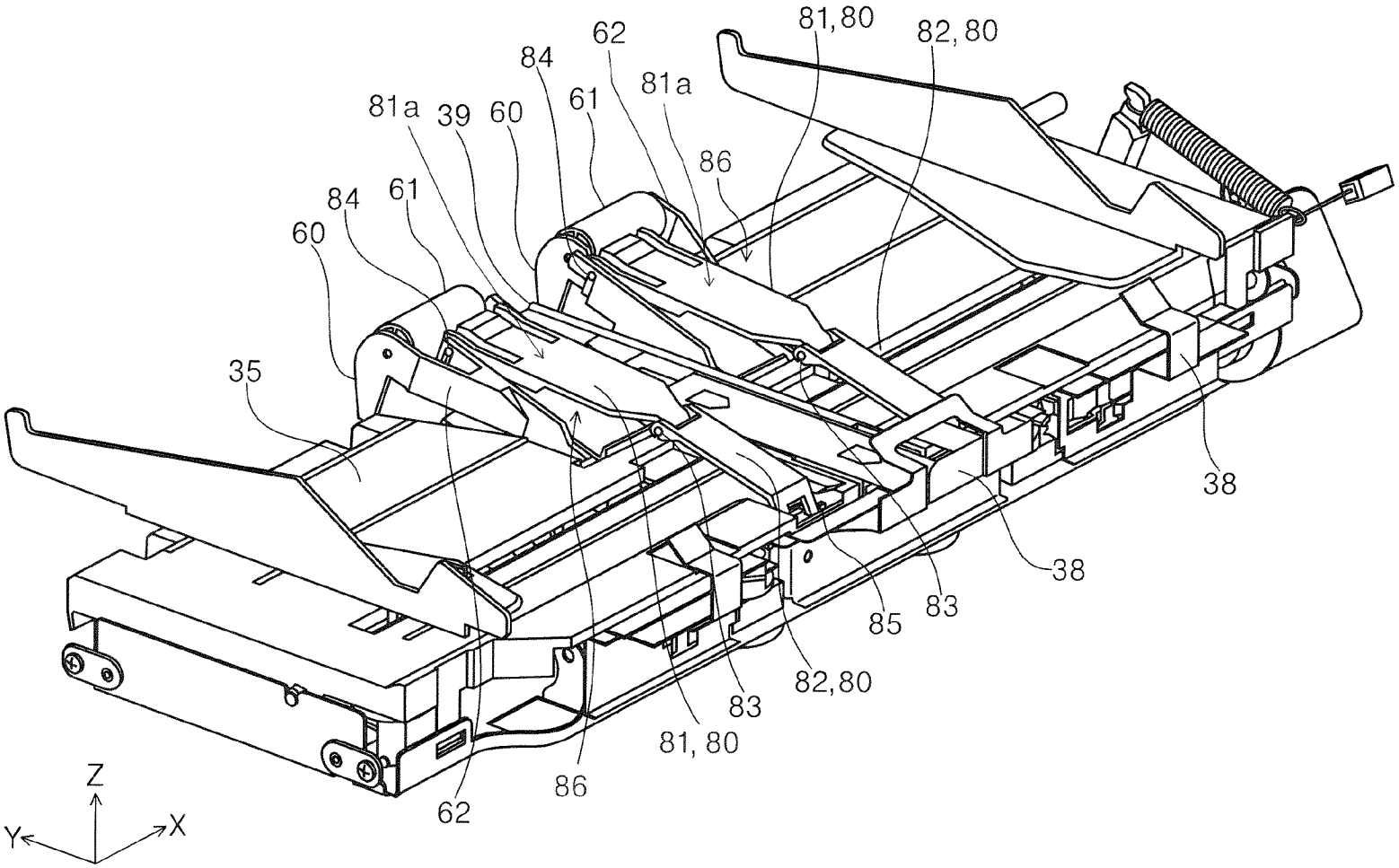
FIG. 13 is a perspective view illustrating the transport rollers at the transporting position and the guide portion in the first state.

The medium transporting apparatus 30 is configured to switch between a first state illustrated in the lower diagram in FIG. 11 and in FIG. 13, and a second state illustrated in the upper diagram in FIG. 11 and FIG. 12, and includes the guide portion 80 that is switched from the second state to the first state when the transport rollers 61 is moved from the retracted position (the upper diagram in FIG. 11 and FIG. 12) to the transporting position (the lower diagram in FIG. 11 and FIG. 13).

The guide portion 80 in the first state illustrated in the lower diagram in FIG. 11 and FIG. 13 is in a state guiding the medium in a direction oriented towards a portion between the transport rollers 61 at the transporting position and the transport belts 40. The guide portion 80 in the second state illustrated in the upper diagram in FIG. 11 and FIG. 12 is in a state situated along a mount surface 35*a* of the first tray 35.

Figure 9:
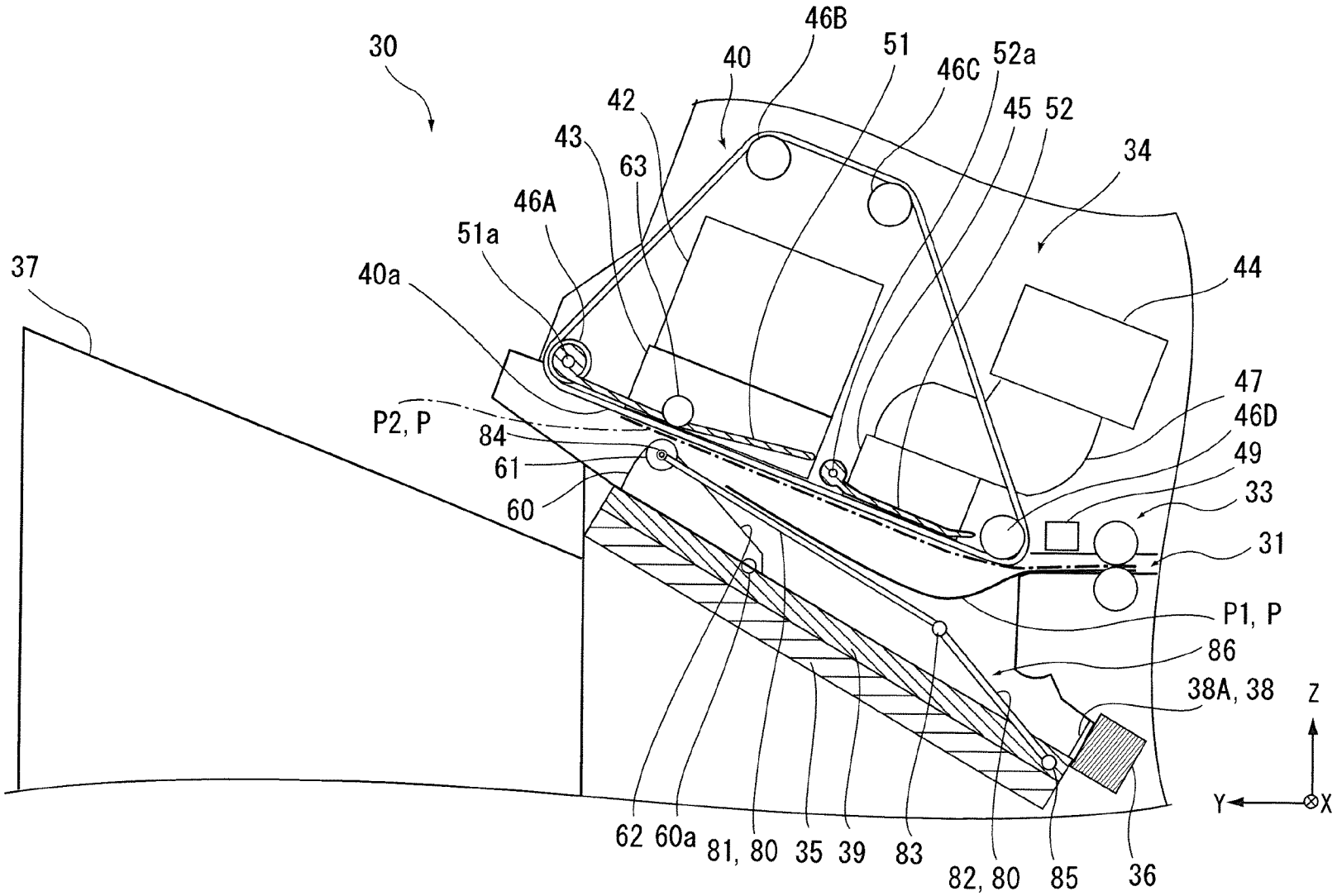
FIG. 9 is a schematic view illustrating a first state of a guide portion.

When the guide portion 80 is in the first state, for example, even if the preceding medium P1 on the lower side among the two mediums P, namely, the preceding medium P1 and the succeeding medium P2, is not suctioned against the transport surface 40*a* and is hanging down as illustrated in FIG. 9, the preceding medium P1 is transported by the pair of second transport rollers 33 and proceeds along the guide portion 80. With the above, the leading edge of the preceding medium P1 in the first transport direction +Y can be guided to and nipped between the transport rollers 61 at the transporting position and the transport belts 40.

Since the guide portion 80 is switched from the second state to the first state when the transport rollers 61 moves from the retracted position to the transporting position, the guide portion 80 can be set to the first state when the transport rollers 61 is moved to the transporting position, in other words, when the plurality of mediums P are transported with the transport belts 40. Accordingly, the preceding medium P1 among the plurality of mediums P that is positioned on the lower side and that is not suctioned against the transport surface 40*a* can be guided between the transport rollers 61 and the transport belts 40.

The guide portion 80 includes link mechanisms 86 illustrated in FIGS. 12 and 13. The link mechanisms 86 interlock the switching pf the guide portion 80 from the second state to the first state with the movements of the transport rollers 61 from the retracted position illustrated in FIG. 12 (see the upper diagram in FIG. 11 as well) to the transporting position illustrated in FIG. 13 (see the lower diagram in FIG. 11 as well).

Referring to FIGS. 12 and 13, the link mechanisms 86 include first arms 81 that are positioned upstream of the transport rollers 61 in the first transport direction +Y and that constitute the guide portion 80, and a second arms 82 that are positioned upstream of the first arms 81 in the first transport direction +Y and that are coupled to the first arms 81. The first arms in the first state illustrated in the lower diagram in FIG. 11 are configured to be in a position in which surfaces 81*a* opposing the transport belts 40 shorten the distance with the transport belts 40 towards the transport rollers 61.

Referring to FIGS. 12 and 13, the first arms 81 are attached in a swingable manner to first pivot shafts 84 provided in the base portions 62. Furthermore, the second arms 82 are attached in a swingable manner to second pivot shafts 85 provided in a −Y direction of the first tray 35. The first arms 81 and the second arms 82 are coupled to each other in a swingable manner with third pivot shafts 83.

When the transport rollers 61 are at the retracted position illustrated in FIG. 12, the first arms 81 and the second arms 82 constituting the guide portion 80 are connected to each other so as to be substantially horizontal to the mount surface 35*a* of the first tray 35 as illustrated in FIG. 11.

When the transport rollers 61 move to the transporting position illustrated in FIG. 13, the base portions 62 rise and, accordingly, as illustrated in FIG. 11, the first arms 81 and the second arms 82 are swung into a mountain shape with the third pivot shafts 83 as the summits so that the first arms 81 are inclined towards the transport rollers 61 at the transporting position.

The medium P can be guided between the transport rollers 61 and the transport belts 40 in a more reliable manner with the link mechanisms 86 configured in the above manner.

Furthermore, the switching of the guide portion 80 from the second state to the first state can be interlocked with the movement of the transport rollers 61 from the retracted position to the transporting position with the simple mechanical composition of the link mechanisms 86. With the above, the movement of the transport rollers 61 and the switching of the states of the guide portion 80 can both be performed with a single drive source.

Note that the movement of the transport rollers 61 and the switching of the states of the guide portion 80 can be performed by providing separate power sources, for example, without resorting to the link mechanisms 86.

Discharge of Medium from First Tray to Second Tray

Referring to FIGS. 14 to 17, a description will be given on the discharge of the medium P from the first tray 35 to the second tray 37.

Figure 14:
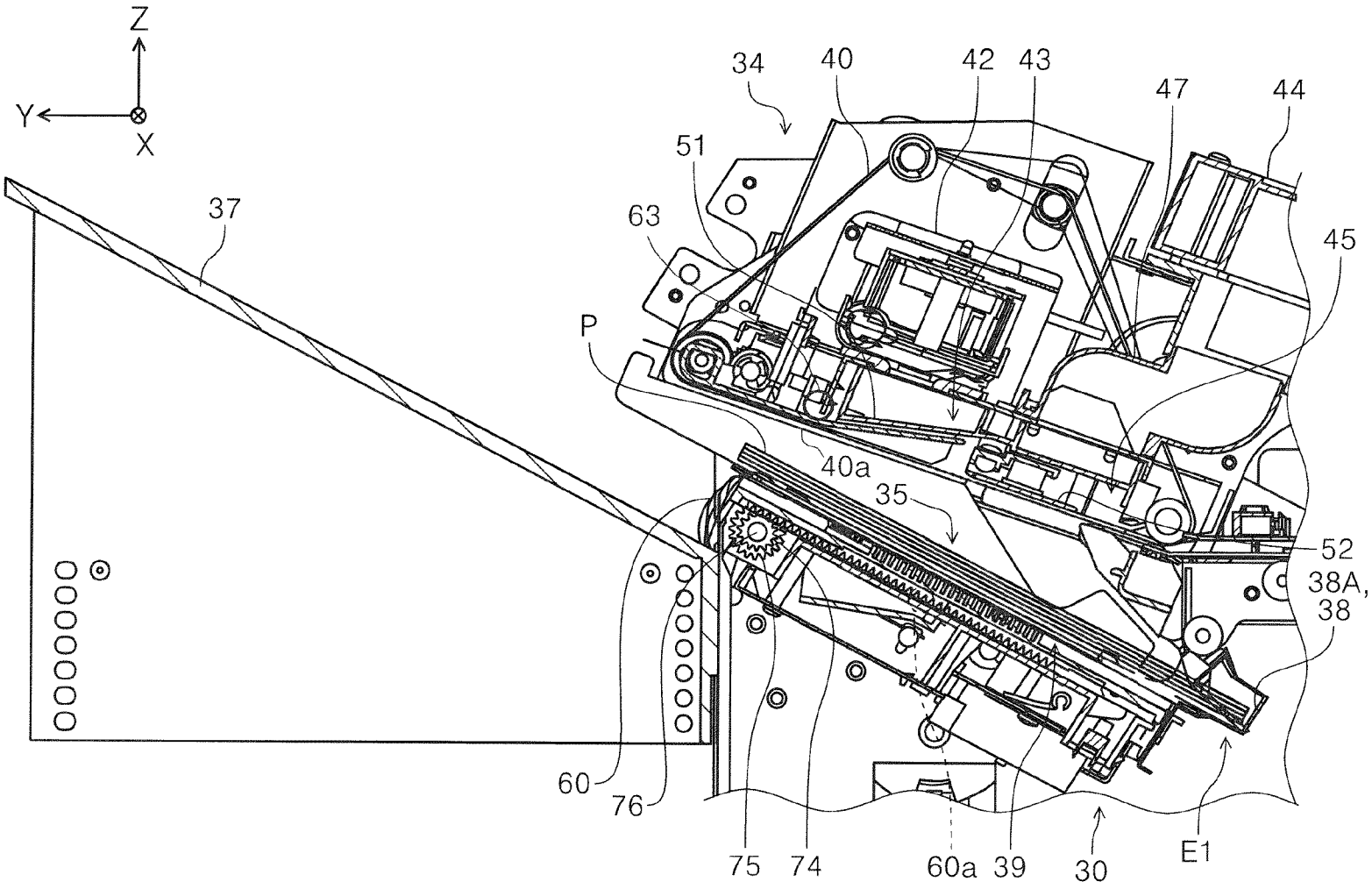
FIG. 14 is a sectional side view of the medium transporting apparatus and illustrates a state in which the support portion is positioned at the first retracted position, the restriction portion is positioned at the non-restricting position, and a bunch of mediums are mounted on the first tray.

FIG. 14 illustrates a state in which the medium P is mounted on the first tray 35.

Figure 15:
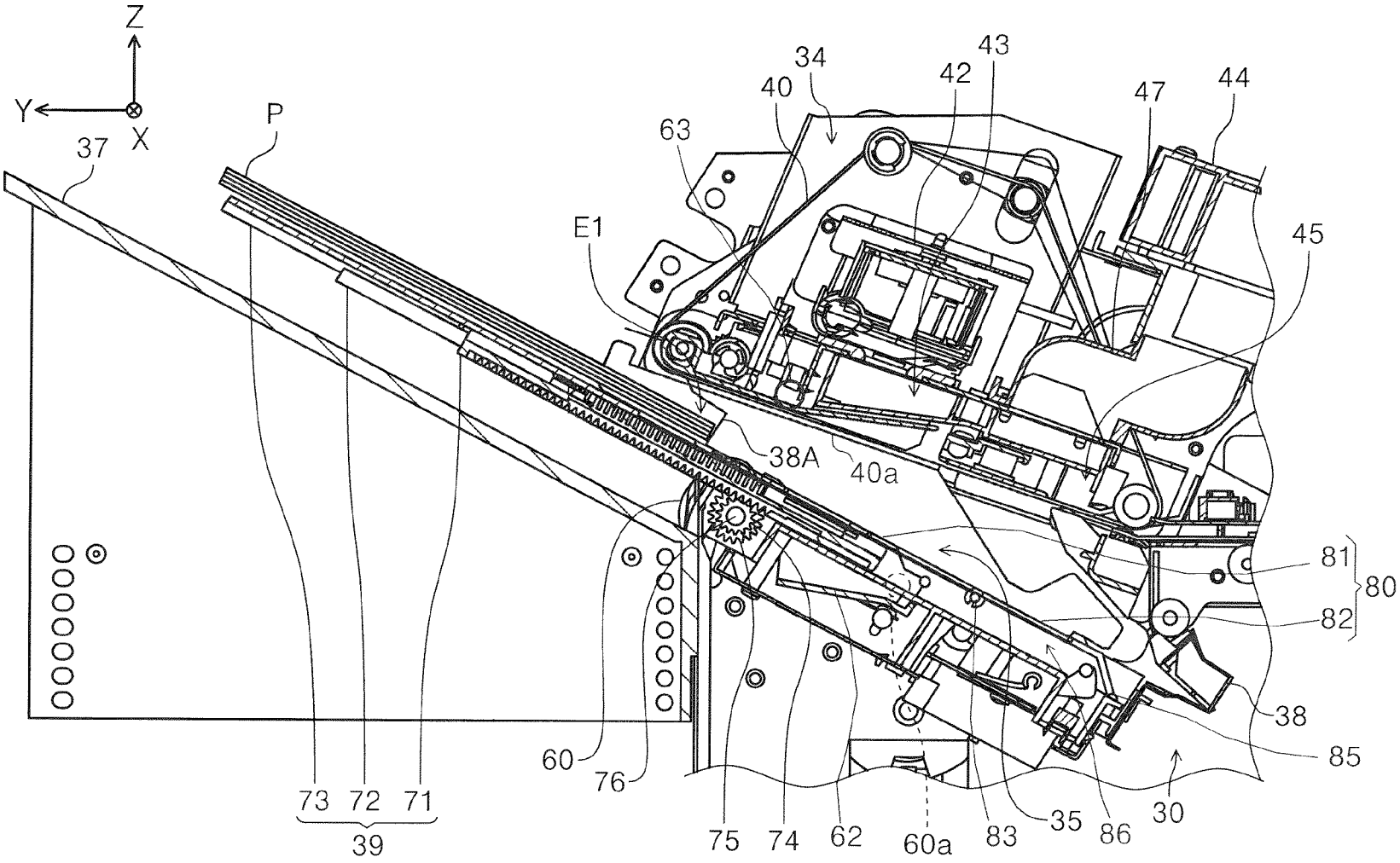
FIG. 15 is a sectional side view of the medium transporting apparatus and illustrates a state in which the support portion supporting the mediums is positioned at the advanced position, and the restriction portion is positioned at the non-restricting position.

The support portion 39 provided in the first tray 35 is configured to be displaced between a first retracted position illustrated in FIG. 14 in which the support portion 39 is positioned inside the first tray 35, and an advanced position illustrated in FIG. 15 in which the support portion 39 is, relative to the first retracted position, advanced from the first tray 35 in the +Y direction that is the discharge direction towards the second tray 37 and is positioned above the second tray 37. The support portion 39 is capable of supporting the medium P at both positions, namely, the first retracted position and the advanced position. The matching portion 38A is provided in the support portion 39. The matching portion 38A follows and moves with the displacement of the support portion 39.

The support portion 39 is configured to extend when displaced from the first retracted position to the advanced position. As illustrated in FIG. 15, the support portion 39 includes a first member 71, a second member 72, and a third member 73. At the first retracted position, the first member 71, the second member 72, and the third member 73 are superposed on each other in the Y-axis direction, and with the displacement from the first retracted position to the advanced position, the first member 71 is slid in the +Y direction relative to the first tray 35, and the second member 72 and the third member 73 are slid in the +Y direction relative to the first member 71 so that the support portion 39 becomes extended.

When the medium P is mounted on the first tray 35 with the transport belts 40, the support portion 39 is disposed at the first retracted position illustrated in FIG. 14. In FIG. 14, the support portion 39 together with the mount surface of the first tray 35 supports the mediums P, and in such a state, the process performed by the processing portion 36 is performed on the mediums P.

When the process performed by the processing portion 36 is performed on the mediums P mounted on the first tray 35, the mediums P are discharged to the second tray 37 from the first tray 35.

When the mediums P are discharged from the first tray 35 to the second tray 37, the support portion 39 is moved from the first retracted position illustrated in FIG. 14 to the advanced position illustrated in FIG. 15. Since the matching portion 38A is provided in the support portion 39 and moves together with the support portion 39, the support portion 39 moves to the advanced position while supporting the mediums P.

Note that the medium transporting apparatus 30 includes the restriction portions 60 configured to, when the support portion 39 is in the advanced position, be displaced between a restricting position (FIG. 16) that restricts, in the +Y direction that is the discharge direction, the upstream movement of the first end portions E1 of the mediums P at the position of the matching portion 38A that moves together with the support portion 39, and a non-restricting position (FIG. 15) that does not restrict the movement.

Figure 16:
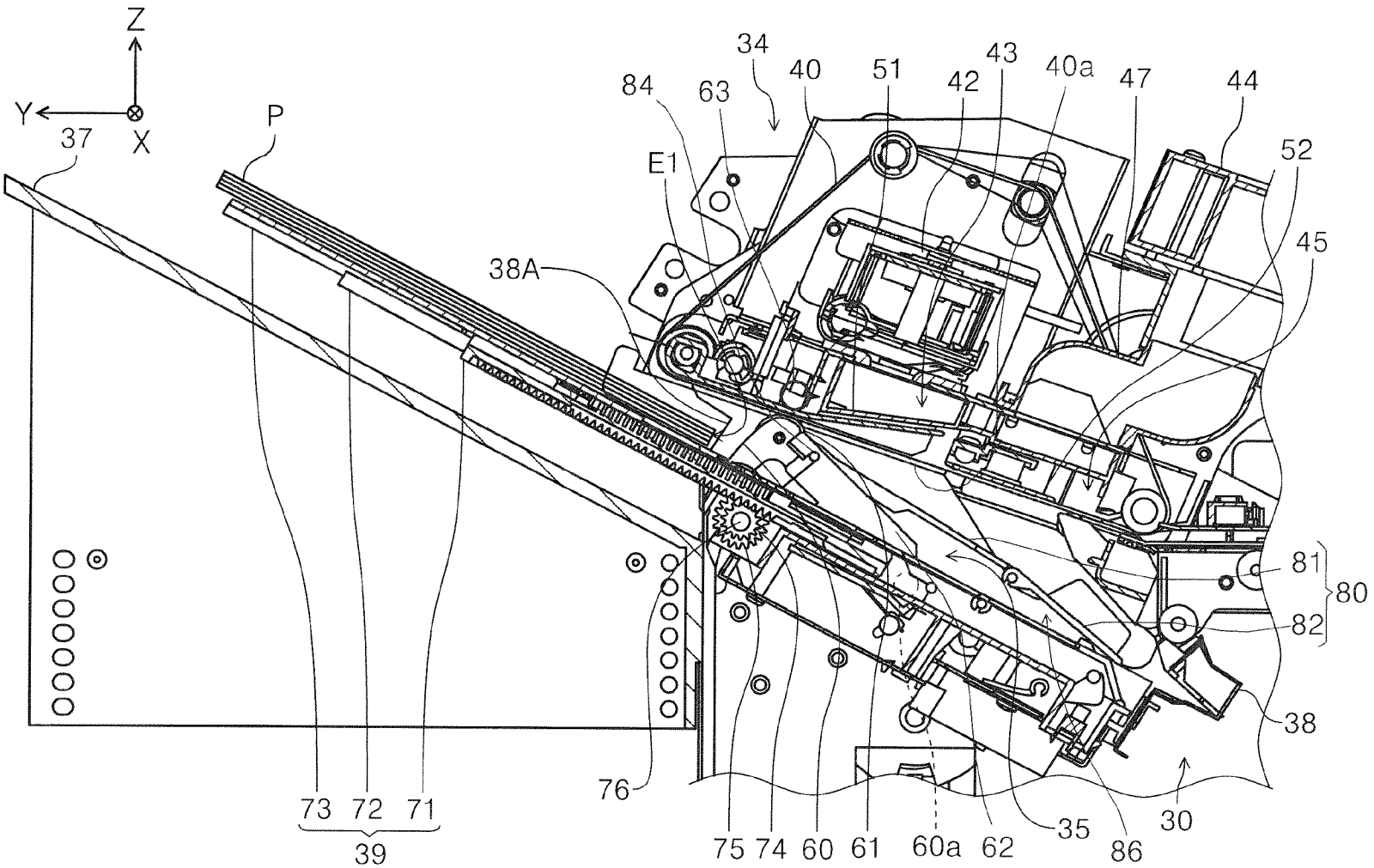
FIG. 16 is a sectional side view of the medium transporting apparatus and illustrates a state in which the support portion supporting the mediums is positioned at the advanced position, and the restriction portion is positioned at the restricting position.

As illustrated in FIG. 16, the restricting position is a position where the restriction portions 60 protrude with respect to the mount surface of the first tray 35 and, as illustrated in FIG. 15, the non-restricting position is a position where the restriction portions 60 have been retracted to the first tray 35 side with respect to the restricting position.

Note that the restricting position is the transporting position of the transport rollers 61, and the non-restricting position is the retracted position of the transport rollers 61.

In the present embodiment, the restriction portions 60 are provided in the base portions 62, and the base portions 62 are configured to swing about the pivot shafts 60*a*, illustrated in FIGS. 15 and 16, between the restricting position (FIG. 16) and the non-restricting position (FIG. 15). The base portions 62 are swung by the motive force of the drive source (not shown).

As illustrated in FIGS. 12 and 13, the restriction portions 60 are disposed at positions offset from the support portion 39 in the X-axis direction, which is the width direction. More specifically, the restriction portion 60 is provided on each of the two sides of the support portion 39 in the width direction.

When the support portion 39 is moved to the advanced position illustrated in FIG. 15, the restriction portions 60 are displaced to the restricting position as illustrated in FIG. 16.

Figure 17:
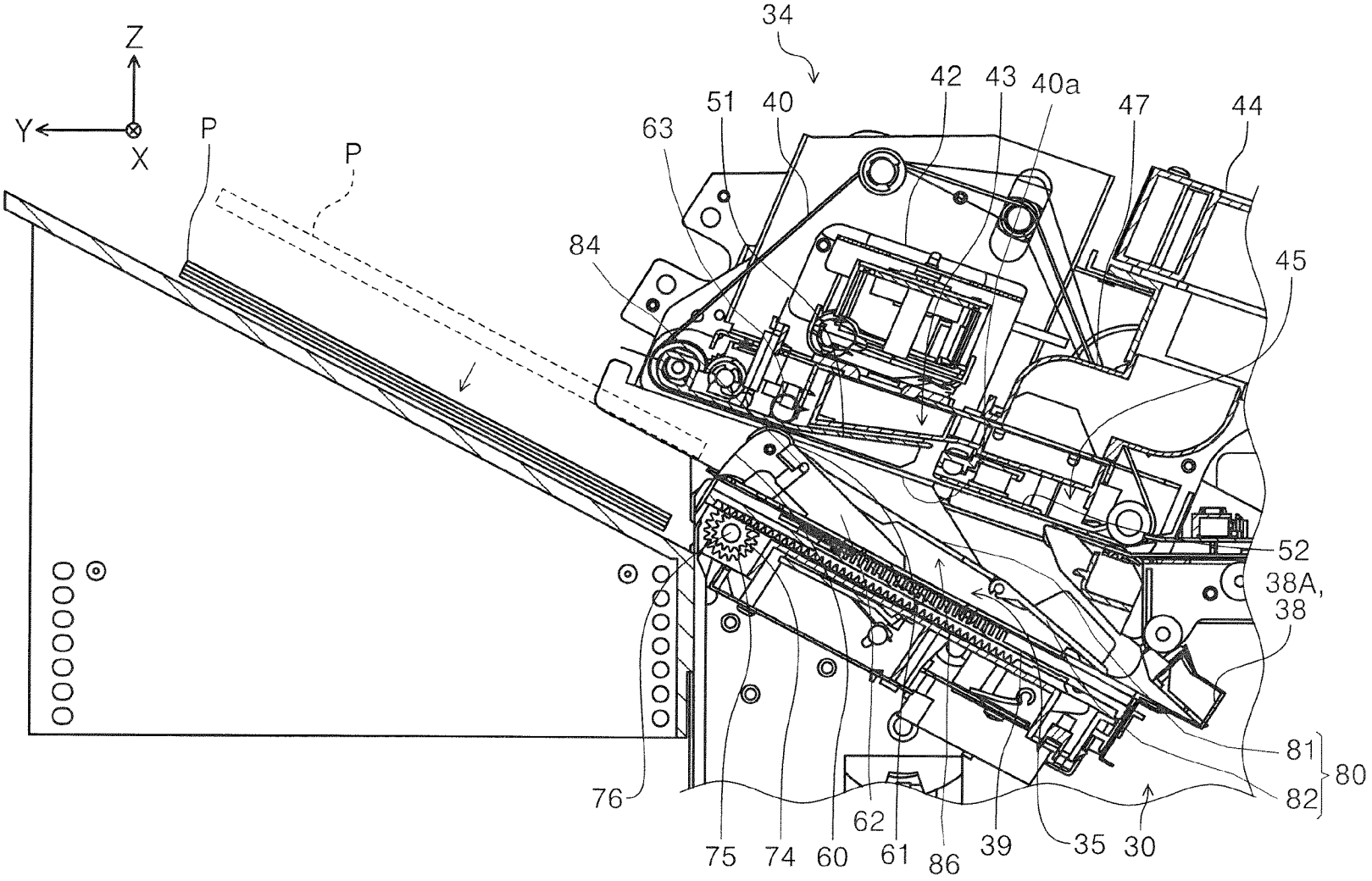
FIG. 17 is a sectional side view of the medium transporting apparatus and illustrates a state in which the support portion is positioned at the first retracted position, the restriction portion is positioned at the restricting position, and a bunch of mediums are mounted on a second tray.

Subsequently, in a state in which the movement of the mediums P in the −Y direction is restricted by the restriction portions 60 situated at the restricting position, as illustrated in FIG. 17, the support portion 39 returns to the first retracted position so that the mediums P that are no longer supported by the support portion 39 fall onto the second tray 37. By having the mediums P be discharged from the first tray 35 to the second tray 37 in the above manner, when a plurality of mediums P are mounted on the first tray 35, the mediums P can be pushed and discharged from the second tray 37 while the matching of the first end portions E1 of the mediums P that have been matched by the matching portion 38 is maintained.

Furthermore, while the transport belts 40 in the present embodiment are of a suction and attraction type, an electrostatic attraction type transport belt can be used.

Furthermore, the second suction area K2 can be omitted from the suction area in the transport belt 40 and the suction area may be the first suction area K1 alone, or a configuration in which three or more suction areas provided with suction force with individual suction devices and individual suction portions can be adopted.

Other Configurations of Medium Transporting Apparatus

Figure 18:
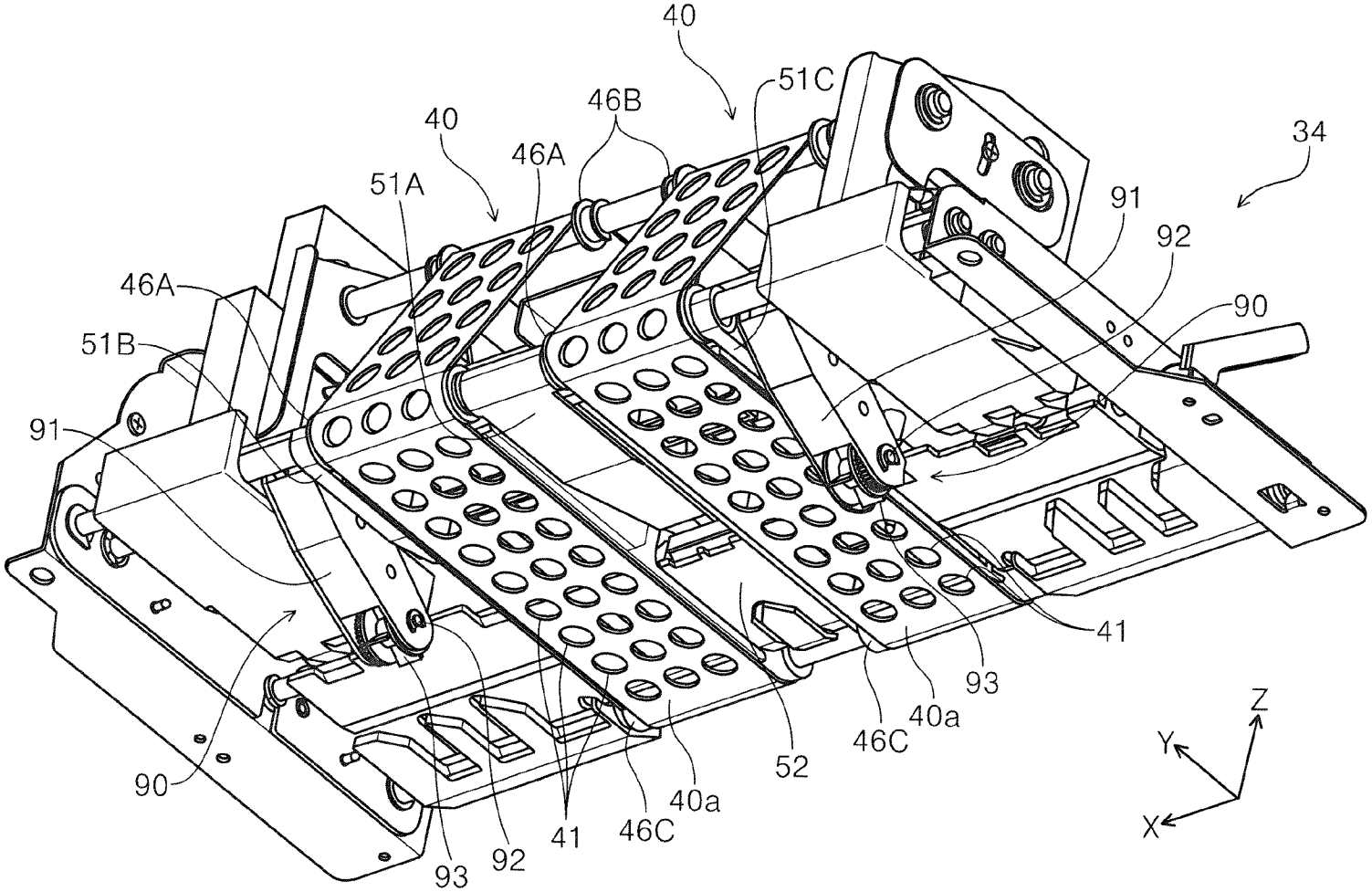
FIG. 18 is a perspective view illustrating another configuration of the medium transporting apparatus.
Figure 19:
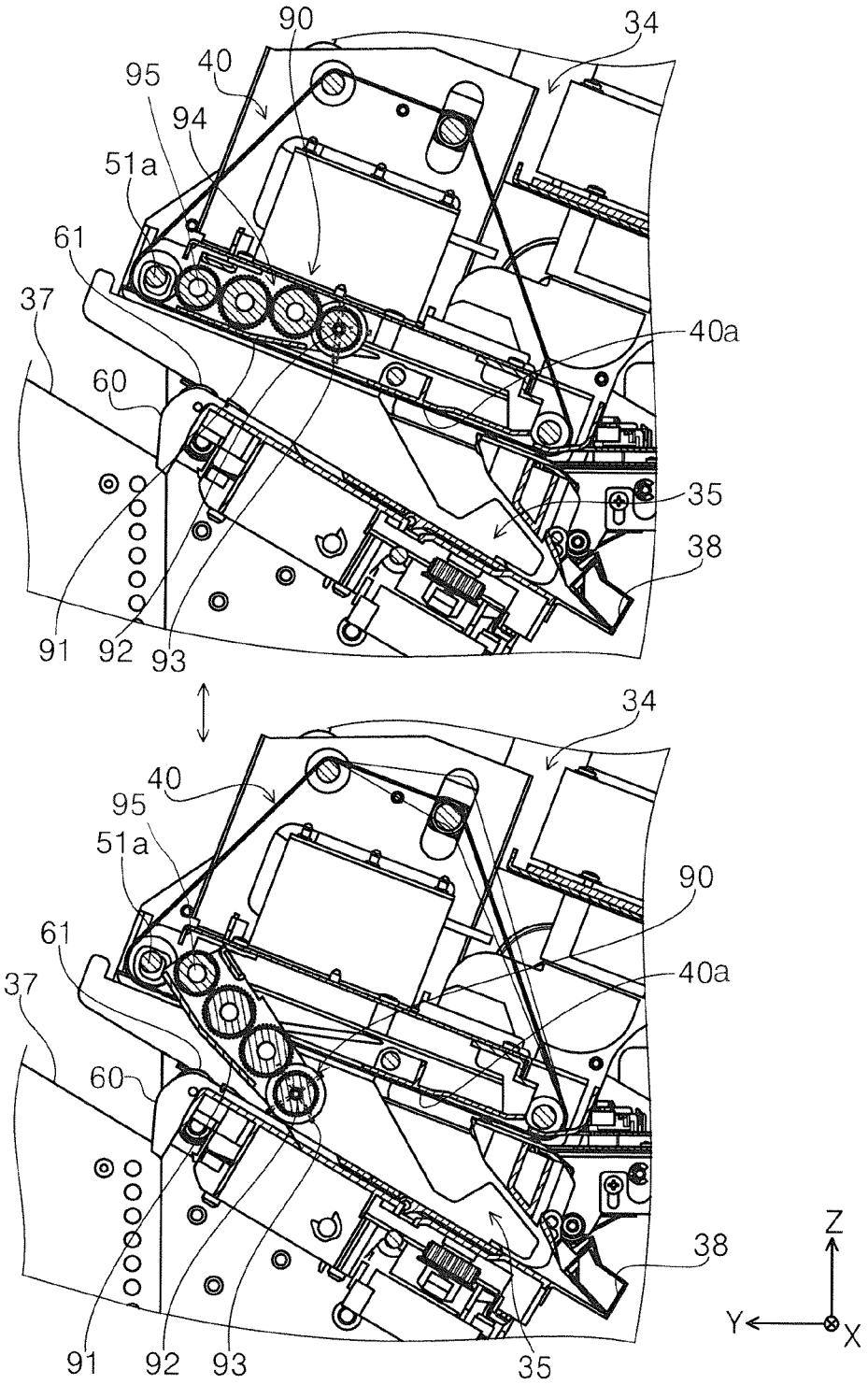
FIG. 19 includes diagrams illustrating an operation of a rotation member.

Referring to FIGS. 18 and 19, other configurations of the medium transporting apparatus 30 will be described.

As illustrated in FIG. 18, the medium transporting apparatus 30 includes a rotation member 90 on each of the two sides of the transport belts 40 in the width direction.

The rotation members 90 include arm portions 91 that swing about the pivot shaft 95 illustrated in FIG. 19, and rotating paddles 93 that rotate about the rotation shafts 92 provided in free ends of the arm portions 91. The rotating paddles 93 are each configured to rotate counterclockwise in FIG. 19 by receiving motive force from a drive source (not shown) through a gear group 94.

The rotation members 90 are, as illustrated in the upper diagram in FIG. 19, configured to swing between a contained position in which the rotation members 90 are contained inside the loops of the transport belts 40, and a rotating position in which, as illustrated in the lower diagram in FIG. 19, the rotating paddles 93 protrude from the transport surfaces 40*a*.

As illustrated in the upper diagram in FIG. 5, when the medium P is sent in the second transport direction −Y with the transport belt 40 while being guided with the second separating device 52 protruding from the transport surface 40*a*, for example, since it is difficult for a medium with high rigidity to move along the second separating device 52, in some cases, the medium P is separated from the first suction area K1 before the first end portion E1 reaches the matching portion 38.

In such a case, by positioning the rotation members 90 at the rotating position and rotating the rotating paddles 93 counterclockwise in FIG. 19, the rotating paddles 93 repel the medium P that has fallen on the first tray 35 before the first end portion E1 had reached the matching portion 38; accordingly, the medium P can be moved towards the matching portion 38.

The timing at which the rotation members 90 are switched from the contained position illustrated in the upper diagram in FIG. 19 to the rotating position illustrated in the lower diagram in FIG. 19 can be determined based on the detection of the medium P with the medium detection portion 49, for example. Other than switching at the same time as the detection of the medium P in the medium detection portion 49, the switching may be performed after a predetermined time has passed after the detection of the medium P in the medium detection portion 49.

There are cases in which the detection of the medium in the medium detection portion 49 is performed by detection of a leading edge (a second end portion E2) of the medium P transported in the first transport direction +Y, and by detection of a trailing edge (the first end portion E1) of the medium P transported in the first transport direction +Y; however, the switching timing may be determined based on either of the detections.

Furthermore, it is desirable that after moving the rotation members 90 to the rotating position and rotating the rotating paddles 93 for a predetermined time or a predetermined number of rotations, and determining that the medium P has moved to the position of the matching portion 38, the rotation members 90 are moved to the contained position. A detection portion configured to detect the medium can be provided at the position of the matching portion 38 and the rotation members 90 can be moved to the contained position at the timing at which the detection portion detects the medium.

Note that when the rotation members 90 are positioned at the rotating position and the rotating paddles 93 are rotated, the medium is sent in the second transport direction −Y with the operation of the rotating paddles 93; accordingly, transporting with the transport belts 40 do not need to be performed.

Note that in the present embodiment, processing unit 4 can be comprehended as a "medium processing apparatus" that includes a medium transporting apparatus 30 and a processing portion 36 that performs a predetermined process on the medium mounted on the first tray 35. Furthermore, the recording system 1 can be comprehended a "medium processing apparatus" that includes a medium transporting apparatus 30 and a processing portion 36 that performs a predetermined process on the medium mounted on the first tray 35. Furthermore, an apparatus in which the recording function has been omitted from the recording system 1 can be comprehended as a "medium transporting apparatus". Alternatively, even provided with a recording function, from the viewpoint of medium transportation, the recording system 1 itself can be comprehended as a medium transporting apparatus.

Note that not limited to the exemplary embodiments described above, various modifications that are within the scope of the claims can be made. It goes without saying that the modifications are also included in the scope of the disclosure.

What is claimed is:

1. A medium transporting apparatus comprising:

a transport belt that transports a medium while suctioning the medium against a transport surface;

a medium mount portion on which the medium transported with the transport belt is mounted; and a transport roller configured to move between a transporting position that nips the medium with the transport belt, and a retracted position that is a position distanced away from the transport belt with respect to the transporting position, wherein the transport roller is positioned at the retracted position when a single medium is transported with the transport belt, and is positioned at the transporting position when a plurality of mediums in a superposed state are transported with the transport belt, the transport belt is configured to rotate in a first direction and a second direction opposite to the first direction, the transport roller is positioned at the retracted position when each single medium of a plurality of media is transported with the transport belt in the first direction, and the transport roller is positioned at the transporting position when the plurality of media in a superposed state are transported with the transport belt in the second direction.

2. The medium transporting apparatus according to claim 1, wherein the transport belt transports the medium in a first transport direction and, after that, transports the medium in a second transport direction that is opposite the first transport direction and mounts the medium on the medium mount portion.

3. The medium transporting apparatus according to claim 2, wherein the transporting position of the transport roller is upstream of a position of a leading edge of the medium in the first transport direction and is downstream of a position of a trailing edge of the medium in the first transport direction when a transport direction of the medium is switched from the first transport direction to the second transport direction.

4. The medium transporting apparatus according to claim 2, wherein the transport roller is configured to move from the transporting position to the retracted position when transporting of the medium to the second transport direction is stopped.

5. The medium transporting apparatus according to claim 1, further comprising:

a guide portion configured to switch between a first state that guides the medium in a direction oriented towards a portion between the transport roller at the transporting position and the transport belt, and a second state in which the guide portion is situated along a mount surface of the medium mount portion, the guide portion being switched from the second state to the first state when the transport roller moves from the retracted position to the transporting position.

6. The medium transporting apparatus according to claim 5, further comprising:

a link mechanism that interlocks a switching of the guide portion from the second state to the first state with a movement of the transport roller from the retracted position to the transporting position.

7. The medium transporting apparatus according to claim 1, further comprising:

a driven roller configured to rotate with a movement of the transport belt, wherein the transport belt is nipped between the transport roller and the driven roller when the transport roller is positioned at the transporting position.

8. The medium transporting apparatus of claim 1, wherein:

when the transport roller is positioned at the retracted position, the transport belt is configured to suck the single medium against the transport surface and transport the single medium without using the transport roller, and when the transport roller is positioned at the transporting position, the transport belt is configured to nip and transport a plurality of media in the superposed state with the transport roller.

9. The medium transporting apparatus of claim 1, further comprising:

a guide portion configured to switch between a first state and a second state, the guide portion comprising a first arm and a second arm coupled to the first arm, wherein when the guide portion is in the first state, the first arm is configured to be in a position opposing the transport belt, such that a distance between the transport belt and the transport roller is shortened, and when the guide portion is in the second state, the first arm and the second arm are positioned in a same direction along a mount surface of the medium mount portion.

10. A medium processing apparatus comprising:

a transport belt that transports a medium while suctioning the medium against a transport surface;

a medium mount portion on which the medium transported with the transport belt is mounted; and a processing portion that performs a process on the medium mounted on the medium mount portion; and a transport roller configured to move between a transporting position that nips the medium with the transport belt, and a retracted position that is a position distanced away from the transport belt with respect to the transporting position, wherein the transport roller is positioned at the retracted position when a single medium is transported with the transport belt, and is positioned at the transporting position when a plurality of mediums in a superposed state are transported with the transport belt, the transport belt is configured to rotate in a first direction and a second direction opposite to the first direction, the transport roller is positioned at the retracted position when each single medium of a plurality of media is transported with the transport belt in the first direction, and the transport roller is positioned at the transporting position when the plurality of media in a superposed state are transported with the transport belt in the second direction.

11. The medium processing apparatus of claim 10, wherein:

when the transport roller is positioned at the retracted position, the transport belt is configured to suck the single medium against the transport surface and transport the single medium without using the transport roller, and when the transport roller is positioned at the transporting position, the transport belt is configured to nip and transport a plurality of media in the superposed state with the transport roller.

12. The medium processing apparatus of claim 10, further comprising:

a guide portion configured to switch between a first state and a second state, the guide portion comprising a first arm and a second arm coupled to the first arm, wherein when the guide portion is in the first state, the first arm is configured to be in a position opposing the transport belt, such that a distance between the transport belt and the transport roller is shortened, and when the guide portion is in the second state, the first arm and the second arm are positioned in a same direction along a mount surface of the medium mount portion.

13. A recording system comprising:

a recording unit that includes a recording device that performs recording on a medium; and a processing unit that performs a process on the medium on which the recording has been performed in the recording unit, wherein the processing unit includes, a transport belt that transports the medium while suctioning the medium against a transport surface, a medium mount portion on which the medium transported with the transport belt is mounted, a processing portion that performs a process on the medium mounted on the medium mount portion, and a transport roller configured to move between a transporting position that nips the medium with the transport belt, and a retracted position that is a position distanced away from the transport belt with respect to the transporting position, wherein the transport roller is positioned at the retracted position when a single medium is transported with the transport belt, and is positioned at the transporting position when a plurality of mediums in a superposed state are transported with the transport belt, the transport belt is configured to rotate in a first direction and a second direction opposite to the first direction, the transport roller is positioned at the retracted position when each single medium of a plurality of media is transported with the transport belt in the first direction, and the transport roller is positioned at the transporting position when the plurality of media in a superposed state are transported with the transport belt in the second direction.

14. The recording system according to claim 13, further comprising:

an intermediate unit that receives, from the recording unit, the medium on which recording has been performed and that delivers the medium to the processing unit.

15. The recording system of claim 13, wherein:

when the transport roller is positioned at the retracted position, the transport belt is configured to suck the single medium against the transport surface and transport the single medium without using the transport roller, and when the transport roller is positioned at the transporting position, the transport belt is configured to nip and transport a plurality of media in the superposed state with the transport roller.

16. The recording system of claim 13, further comprising:

a guide portion configured to switch between a first state and a second state, the guide portion comprising a first arm and a second arm coupled to the first arm, wherein when the guide portion is in the first state, the first arm is configured to be in a position opposing the transport belt, such that a distance between the transport belt and the transport roller is shortened, and when the guide portion is in the second state, the first arm and the second arm are positioned in a same direction along a mount surface of the medium mount portion.

* * * * *